US010034586B2

(12) United States Patent
Goble

(10) Patent No.: US 10,034,586 B2
(45) Date of Patent: Jul. 31, 2018

(54) PERMANENT WET WIPE DISPENSING CONTAINER WITH DECORATIVE FACEPLATE INSTALLED INTO A WALL

(71) Applicant: Jesse M. Goble, Castle Pines, CO (US)

(72) Inventor: Jesse M. Goble, Castle Pines, CO (US)

( * ) Notice: Subject to any disclaimer, the term of this patent is extended or adjusted under 35 U.S.C. 154(b) by 0 days.

(21) Appl. No.: 14/624,273

(22) Filed: Feb. 17, 2015

(65) Prior Publication Data

US 2015/0230673 A1 Aug. 20, 2015

Related U.S. Application Data

(60) Provisional application No. 61/940,252, filed on Feb. 14, 2014.

(51) Int. Cl.

| | |
|---|---|
| ***A47K 10/24*** | (2006.01) |
| ***B65H 1/00*** | (2006.01) |
| ***A47K 10/42*** | (2006.01) |
| *A47K 10/32* | (2006.01) |

(52) U.S. Cl.

CPC .... *A47K 10/421* (2013.01); *A47K 2010/3233* (2013.01); *A47K 2010/3266* (2013.01); *A47K 2010/3293* (2013.01)

(58) Field of Classification Search

CPC ..... A47K 10/422; A47K 2010/3246; A47K 10/421; A47K 210/3266

USPC ..... 221/45

See application file for complete search history.

(56) References Cited

U.S. PATENT DOCUMENTS

| | | | | |
|---|---|---|---|---|
| 7,568,593 | B2 * | 8/2009 | Cittadino | A47K 10/422 221/154 |
| 8,863,984 | B2 * | 10/2014 | Siebel | A47K 10/422 221/154 |
| 8,991,646 | B2 * | 3/2015 | Wieser | A47K 10/421 206/494 |
| 9,198,546 | B1 | 12/2015 | Brown | |
| 9,334,077 | B2 * | 5/2016 | Clouser | B65C 11/00 |
| 2002/0030045 | A1 * | 3/2002 | Nakamura | A47K 10/422 219/386 |
| 2004/0206769 | A1 * | 10/2004 | Sanders | A47K 10/422 221/59 |
| 2005/0133387 | A1 * | 6/2005 | Cohen | B65D 83/0805 206/233 |
| 2013/0048666 | A1 * | 2/2013 | Siebel | A47K 10/422 221/283 |
| 2014/0326745 | A1 * | 11/2014 | Young | A47K 10/422 221/45 |

FOREIGN PATENT DOCUMENTS

| | | | | |
|---|---|---|---|---|
| EP | 1084670 | A3 * | 5/2003 | A47K 10/422 |
| EP | 1084670 | A3 * | 5/2003 | A47K 10/422 |
| EP | 1656870 | A2 * | 5/2006 | A47K 10/422 |
| EP | 1656870 | A2 * | 5/2006 | A47K 10/422 |
| EP | 2826408 | A1 * | 1/2015 | A47K 10/421 |
| EP | 2826408 | A1 * | 1/2015 | A47K 10/421 |
| WO | WO 2006132696 | A1 * | 12/2006 | A47K 10/422 |
| WO | WO-2006132696 | A1 * | 12/2006 | A47K 10/422 |

* cited by examiner

*Primary Examiner* — Rakesh Kumar

(74) *Attorney, Agent, or Firm* — Dykema Gossett PLLC

(57) ABSTRACT

A permanent wipe dispensing container with a faceplate installed into a wall is disclosed. The wipe dispensing container described herein provides a permanent solution to house and dispense wipes with a single hand, is recess mounted in the wall, and can change appearance with interchangeable faceplates.

15 Claims, 27 Drawing Sheets

401
405
409
411
407

403

407
405
401

PERMANENT WET WIPE DISPENSING CONTAINER WITH DECORATIVE FACEPLATE INSTALLED INTO A WALL

CROSS-REFERENCE TO RELATED APPLICATIONS

This application claims the benefit of U.S. provisional application No. 61/940,252, filed 14 Feb. 2014, which is hereby incorporated by reference as though fully set forth herein.

BACKGROUND a. Field

This disclosure relates to systems to provide and dispense wipes. In particular, the instant disclosure relates to systems and apparatuses for dispensing wipes with a single hand, is recess mounted in the wall, and can change appearance with interchangeable faceplates.

b. Background

Most containers to dispense wipes are temporary and can be difficult to use and take up an undesired amount of space. Containers that can be affixed to a substrate are bulky and surface mounted and cannot be recess mounted into a substrate.

BRIEF SUMMARY

The instant disclosure relates to systems to provide and dispense wipes. In particular, the instant disclosure relates to systems and apparatuses for dispensing wipes with a single hand, is recess mounted in the wall, and can change appearance with interchangeable faceplates.

In one embodiment, a tissue dispenser comprises a faceplate comprising a lid, a hinge, a handle, a dispensing opening, a dispenser gasket; and a plurality of first coupling members; and a tissue receptacle comprising at least one flange, a plurality of complementary coupling members, a first side wall, a second side wall, a back wall, a lower wall, and an upper wall. The dispenser gasket comprises a dispenser opening and is configured to cover the dispenser opening, the first side wall, the second side wall, the back wall, the lower wall, and the upper wall form a box configured to store wipes, the hinge swingingly connects the lid to an open position and a closed position, and each of the plurality of first coupling members is configured to interact with a corresponding one of the plurality of complementary coupling members to releaseably connect the faceplate with the tissue receptacle.

In another embodiment, a tissue dispenser comprises a faceplate comprising a hinge receptacle, a first hinge plate depression, a second hinge plate depression, a dispensing opening, a dispensing gasket, a lid border, a locking channel and a plurality of first coupling members; a lid comprising a hinge portion, a handle tab, at least one hinge depression, a front face, and a back face; a hinge plate comprising a hinge opening, a first hinge plate protrusion, a second hinge plate protrusion, a first hinge plate depression, and a second hinge plate depression; and a tissue receptacle comprising at least one flange, a plurality of complementary coupling members, a first side wall, a second side wall, a back wall, a lower wall, and an upper wall. The first side wall, the second side wall, the back wall, the lower wall, and the upper wall form a box configured to store wipes, the hinge swingingly connects the lid to an open position and a closed position, the hinge plate is configured to releaseably couple to the lid and to the faceplate to allow the lid to move to an open and closed position, the first hinge plate depression releaseably couples to the first hinge plate protrusion and the second hinge plate depression releaseably couples to the second hinge plate protrusion, and each of the plurality of first coupling members is configured to interact with a corresponding complementary coupling member to releaseably connect the faceplate with the tissue receptacle.

In yet another embodiment, a tissue dispenser comprises a faceplate comprising a hinge receptacle, at least one hinge plate depression, a dispensing opening, a dispensing gasket, a lid border, a locking channel and a plurality of first coupling members; a lid comprising a hinge portion, a handle tab, at least one hinge depression, a front face, and a back face; a hinge plate comprising a hinge opening and at least one hinge plate protrusion; a tissue receptacle comprising at least one flange, a plurality of complementary coupling members, a first side wall, a second side wall, a back wall, a lower wall, an upper wall, a heater, a motion sensor, and a power source. The first side wall, the second side wall, the back wall, the lower wall, and the upper wall form a box configured to store wipes, the heater is electrically coupled to the power source and to the motion sensor and is configured to heat an interior of the tissue receptacle when motion is sensed by the motion sensor, the hinge swingingly connects the lid to an open position and a closed position, the hinge plate is configured to releaseably couple to the lid and to the faceplate to allow the lid to move to an open and closed position, the at least one hinge plate depression releaseably couples to the at least one hinge plate protrusion, and each of the plurality of first coupling members is configured to interact with a corresponding complementary coupling member to releaseably connect the faceplate with the tissue receptacle.

The foregoing and other aspects, features, details, utilities, and advantages of the present disclosure will be apparent from reading the following description and claims, and from reviewing the accompanying drawings

DETAILED DESCRIPTION

Several embodiments of systems to provide and dispense wipes are disclosed herein. In general, systems and apparatuses for dispensing wipes with a single hand, is recess mounted in the wall, and can change appearance with interchangeable faceplates. Details of the various embodiments of the present disclosure are described below with specific reference to the figures.

In an embodiment Temporary wipe dispensers that are not secured to a location can take up space and do not offer permanent space saving solutions for dispensing wipes. In addition, a person needs two hands in order to dispense wipes from a temporary dispenser. This can be inconvenient, color options are limited, and placement of the container is space consuming and awkward. Surface mounted dispensers protrude from the surface they are mounted to and cannot be mounted permanently inside of a substrate. They can further be unsightly, space consuming, and limited in finish.

The disclosure described herein provides a permanent solution to house and dispense wipes with a single hand, is recess mounted in the wall, and can change appearance and function with interchangeable faceplates and accessories.

Most containers to dispense wipes are temporary and not made to be affixed into a substrate. The containers that can be affixed to a substrate are surface mounted and are not intended to, and cannot be recess mounted. Furthermore, interchangeable faceplates are not offered.

This dispenser described herein can be recessed into a wall as a permanent fixture to hold and dispense wipes. The dispenser can receive interchangeable faceplates in optional finishes and can include areas for interchangeable accessories that increase convenience and product use.

This disclosure enables the person to have a permanent decorative fixture recessed into a wall in which the person can dispense wipes with one hand, and that can be refilled as needed with desired wet wipes. The interior of the dispenser can hold various sizes and amounts of wipes. Also, a person using the dispenser has the ability to change the faceplate in order to match existing adjacent fixtures, hardware, or room décor.

Figure 1:
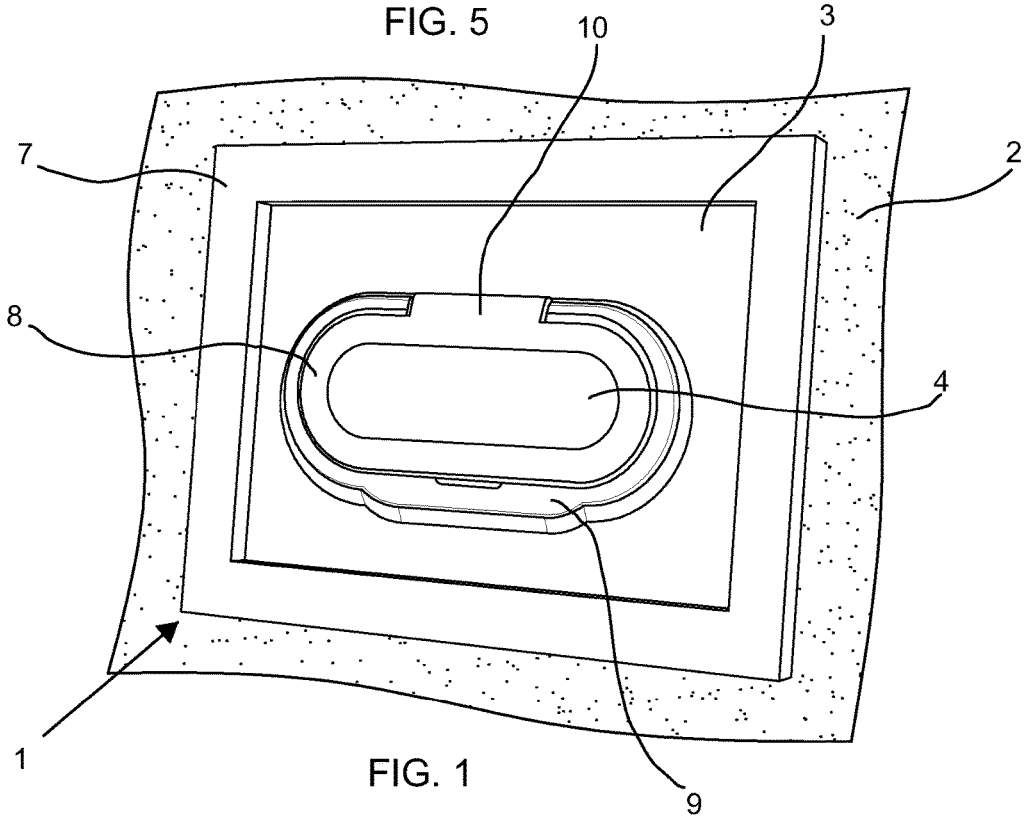
FIG. 1 is an isometric view of a dispenser installed with a substrate.

FIG. 1 depicts an isometric view of the dispenser 1 as it would appear after installation by a substrate 2. The visible portion of the dispenser 1 can comprise a faceplate 3, a lid 4, and a hinge 10. The faceplate 3 can be sized to obscure or hide the opening that a dispensing box is placed within. In one embodiment, the faceplate 3 can comprise a plastic material. In other embodiments, the faceplate can comprise a rubber, metal, wood, or other material. The faceplate 3 can comprise an outer band 7 that forms an outer edge of the faceplate 3. In one embodiment, the outer band 7 can be thicker than the rest of the faceplate 3 and can be used to add structural integrity to the faceplate 3. The hinge 10 can be integral with the lid 4. In other embodiments, the hinge can be a separate piece that can be connected to the lid and to the faceplate. The lid 4 can further comprise a handle 9. The handle 9 can protrude above the faceplate 3 when the lid 4 in a closed position. The lid 4 can be in a closed position when it is completely covering the wipe opening. The wipe opening can be seen in FIG. 5. The lid 4 can further comprise a border 8 around an exterior circumference of the outward facing portion of the lid 4. In some embodiments, the border can be decorative in nature and can be further used to match the faceplate and the lid to existing adjacent fixtures, hardware, or room décor.

The tissue dispenser mounts inside of a cavity within or behind a substrate to house wet wipes. As the size of a cavity can vary with the location the cavity is located, the size of the tissue dispenser discussed herein can also vary. Many homes and businesses are constructed with 2×4 framing for interior walls. As a result, in some embodiments the tissue receptacle disclosed herein can fit within the space between the walls present in already constructed locations. In other locations, the tissue dispenser disclosed herein can fit in cavities of larger or smaller depth. The faceplate attaches to the tissue dispenser. The faceplate houses a rubber opening from which the wipes exit the tissue dispenser. The rubber opening can be coupled to the faceplate or can be integral to the faceplate. The operable door or lid is mounted on the outside of the faceplate which when opened allows access to wipes and when closed covers the rubber opening.

The tissue dispenser is inserted into a cavity cut into the substrate and then secured by turning screws that are attached to tabs clockwise until the tabs are snug sandwiching substrate between tabs and a tissue dispenser flange. Wipes are placed inside the tissue dispenser leaving an outside wipe pulled slightly from other wipes. With the lid open, place faceplate in front of the tissue dispenser and pull an outside wipe through the rubber opening until the wipe is exposed by one inch outside of the rubber opening. Attach the faceplate to the tissue dispenser. Close the lid by pressing in a downward motion until the lid latches.

Figure 2:
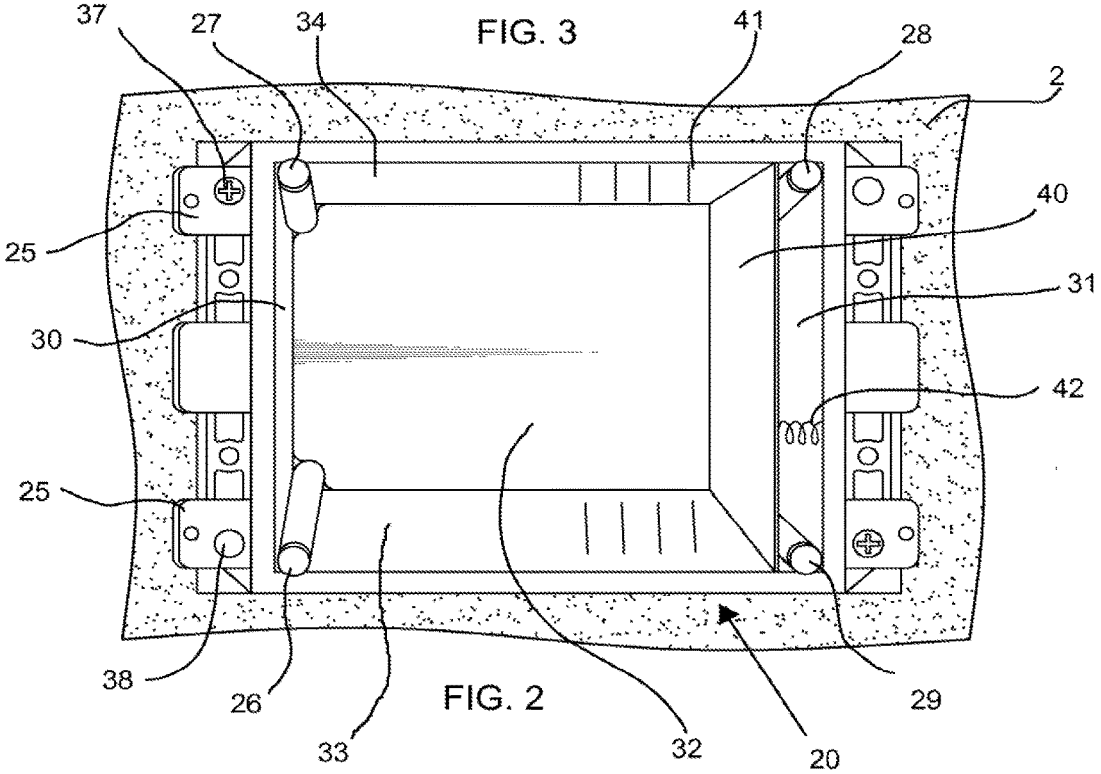
FIG. 2 is a front view of an embodiment of a tissue receptacle.

FIG. 2 depicts a front view of a tissue receptacle 20. The tissue receptacle 20 can comprise at least one flange 25, a first complementary coupling member 26, a second complementary coupling member 27, a third complementary coupling member 28, a fourth complementary coupling member 29, a first side wall 30, a second side wall 31, a back wall 32, a lower wall 33, and an upper wall 34. The at least one flange 25 can be sized and configured to accept a screw 37 and can be used to secure the tissue receptacle 20 to a substrate 2. The illustrated embodiment depicts six flanges and two screws. The illustrated embodiment further shows a screw hole 38 in two flanges in opposing corners that do not contain screws. Other embodiments can have varying numbers of flanges and screws needed to secure the tissue receptacle 20 to a substrate. In other embodiments, the flange can be any device used to secure the tissue receptacle to a substrate. The first, second, third, and fourth complementary coupling members 26, 27,28, 29 can be configured to couple a faceplate to the tissue receptacle 20. The complementary coupling members described herein can be coupled to the plurality of first coupling members shown in FIG. 7B. In other embodiments, the tissue receptacle can have one or more complementary coupling members to secure the tissue receptacle to a faceplate. In yet other embodiments, the complementary coupling members can comprise depressions that can accept a protruding portion of a faceplate. In yet another embodiment, the complementary coupling members of the tissue receptacle can be flush with a forward face of the tissue receptacle and can be magnetized. The magnets can interact with magnets on a faceplate to secure the faceplate to the tissue receptacle. Other connections are also possible as known in the art to couple a faceplate to a tissue receptacle. The walls of the receptacle box can form a rectangular space to store wipes of various quantities and sizes. In the illustrated embodiment, the tissue receptacle 20 can further comprise a plurality of slots 41, a divider 40, and a spring 42. The divider 40 can be used to adjust the amount of space the wipes can sit within the tissue receptacle 20. By adjusting the positioning of the divider 40 movement of the wipes can be restricted. The plurality of slots 41 can be configured to interact with the divider so that a user can place the divider at a desired location within the tissue receptacle 20. The divider 40 can comprise at least one protrusion (not shown) that can interact with the plurality of slots. In other embodiments the divider can be coupled to a spring. The spring 42 can further be coupled to a wall of the tissue receptacle and can push the divider away from the wall that the spring is coupled to. The spring can then automatically adjust the divider to sit against wipes that are placed within the tissue receptacle. In another embodiment the divider can be parallel to the back wall 32 of FIG. 2. The spring can be coupled to the divider and to the back wall 32. The divider can be used to press the wipes forward and ensure a forward portion of the wipes are adjacent a faceplate of the dispenser.

Figure 3:
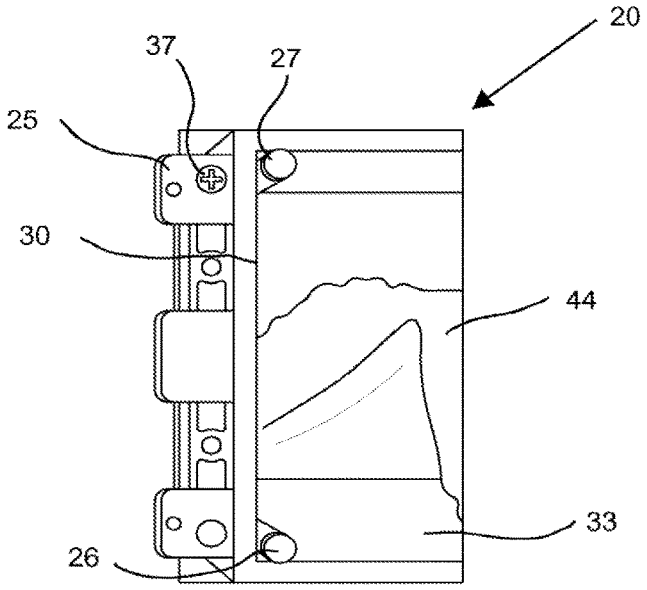
FIG. 3 is a partial view of the tissue receptacle of FIG. 2 with a wipe placed in the tissue receptacle.

FIG. 3 illustrates a partial view of the tissue receptacle 20 of FIG. 2 with a plurality of wipes 44 within the tissue receptacle 20. The plurality of wipes 44 can rest on a lower wall 33 of the tissue receptacle 20. In the illustrated embodiment the plurality of wipes 44 are adjacent a first side wall 30. In other embodiments the plurality of wipes can be positioned between the first side wall and the second side wall. In one embodiment the tissue receptacle can include a first divider and a second divider. The first divider can be coupled to a spring that can be further coupled to the first side wall. The second divider can be coupled to a spring that can be coupled to the second side wall. The first divider and the second divider can work tougher to keep the plurality of wipes mostly equally spaced between the first side wall and the second side wall.

Figure 4:
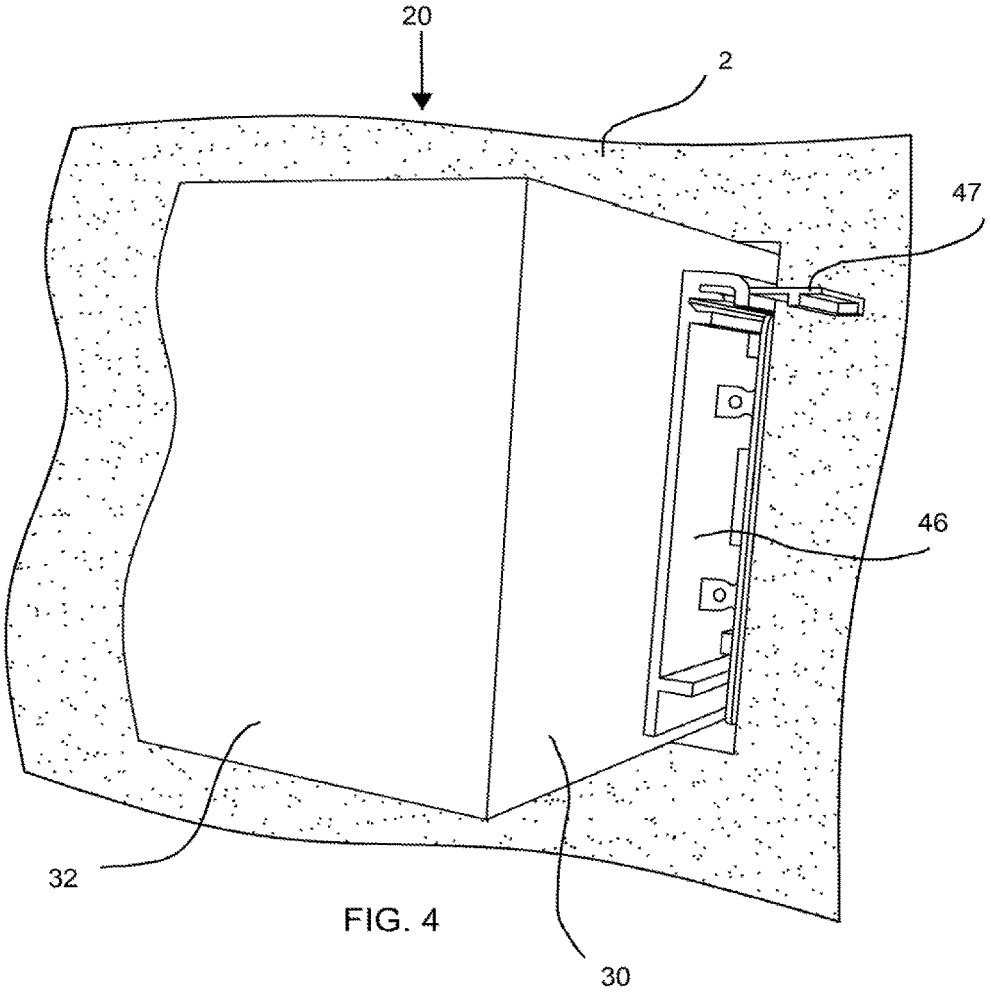
FIG. 4 is an isometric back view of the tissue receptacle of FIG. 2 installed against a substrate.

FIG. 4 depicts a rear isometric view of the tissue receptacle 20 in FIG. 2. The back wall 32 and first side wall 30 can be seen in this FIG. The tissue receptacle 20 can further comprise a receptacle bracket 46. The receptacle bracket 46 can be coupled to the tissue receptacle 20 and can comprise at least one tab 47. The at least one tab 47 can be configured to secure the tissue receptacle 20 to a substrate 2. While FIG. 4 illustrates a first side wall and a receptacle bracket, in other embodiments a second side wall of the tissue receptacle can comprise a second receptacle bracket. The second receptacle bracket can comprise a separate tab configured to secure the tissue receptacle to a substrate.

Figure 5:
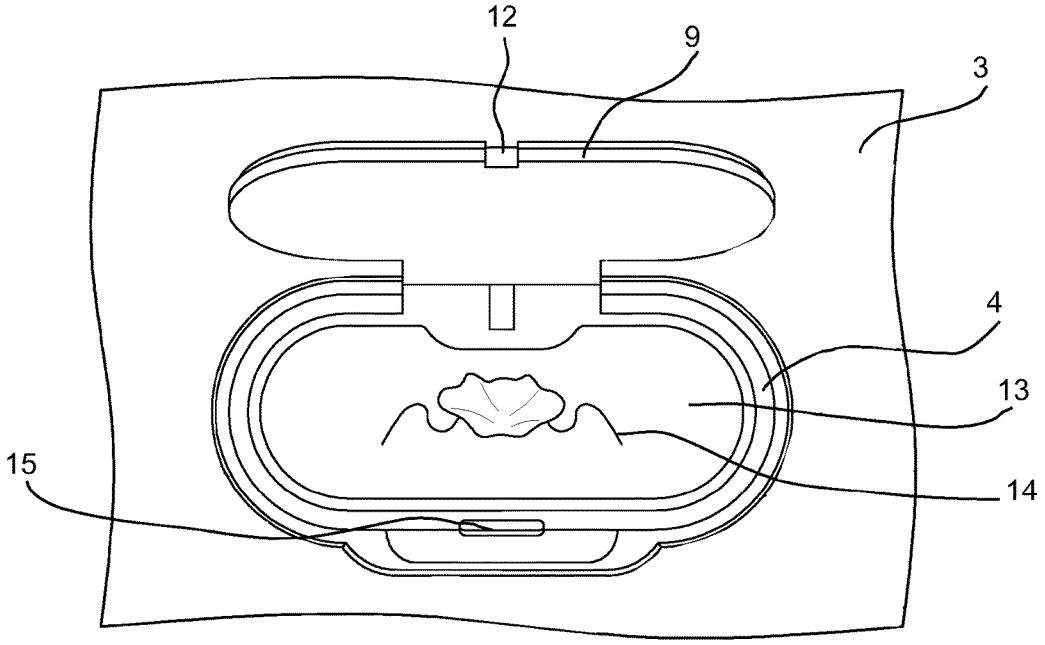
FIG. 5 is a front view of a faceplate with a lid in the open position.

FIG. 5 shows a close-up view of the faceplate 3 as seen in FIG. 1. The lid 4 of the faceplate 3 can comprise a handle 9, a locking tab 12, and a locking channel 15, and is in the open position in FIG. 5. The faceplate 3 can further comprise a dispenser gasket 13 and a dispenser opening 14 The dispenser opening 14 can comprise various shapes to allow a user to remove a wipe from the tissue receptacle. In the illustrated embodiment, the dispenser opening 14 can comprise an interlocking pattern. The interlocking pattern can comprise a line defining plurality of rounded projections that can inlock with other similar projections. The interlocking pattern can be utilized to hold a wipe stationary between uses. As a result, a user can pull wipes from the tissue receptacle, leaving an outside wipe pulled slightly from the other wipes. With the lid 4 open, the faceplate 3 can be placed in front of the tissue receptacle and one of the outside wipes can be pulled through the dispenser opening 14 of the dispenser gasket 13 until a wipe is exposed by around one inch outside of the dispenser gasket 13. The faceplate 3 can then be attached to the tissue receptacle. The lid 4 can then be closed by pressing in a downward motion until the lid 4 latches to the faceplate 3. While the illustrated embodiment depicts a lid with a hinge at the top portion of the lid in other embodiments the lid can be hinged in other locations. It is contemplated having a lid with a hinge at the bottom that can be pulled down to be opened, or hinges on either side of the lid so that the lid can be opened sideways. In another embodiment, the lid can be coupled to a spring such that when opened, the spring can keep the lid in the open position. The lid can then be pressed back into the closed position and kept closed through a friction fit, a latch, or the like.

Figure 6B:
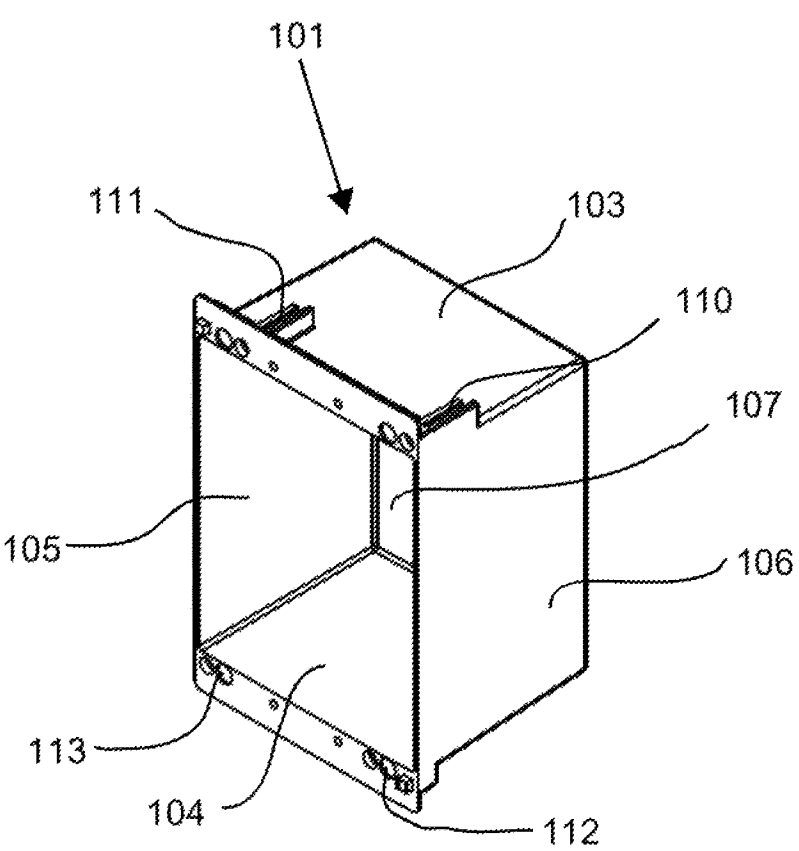
FIGS. 6A-6G are various views of an embodiment of a tissue receptacle.
Figure 6A:
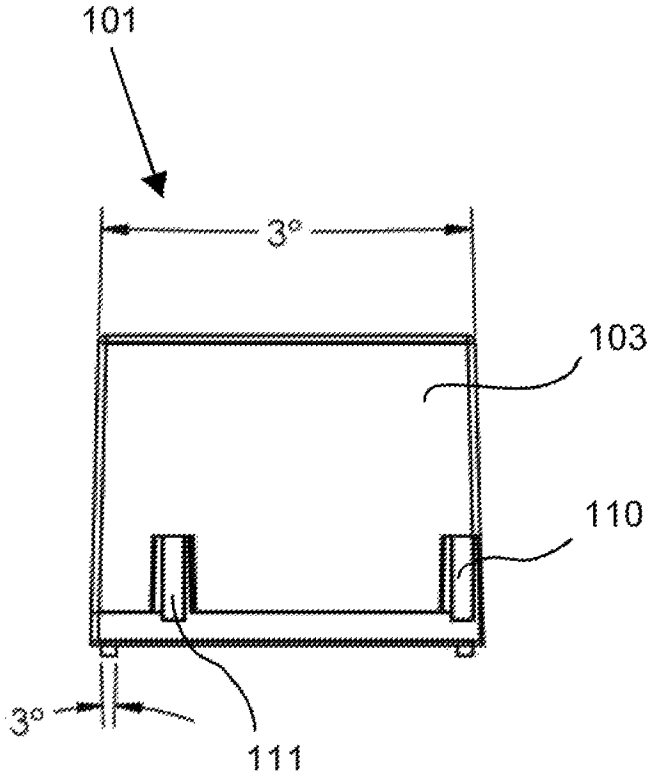
Figure 6D:
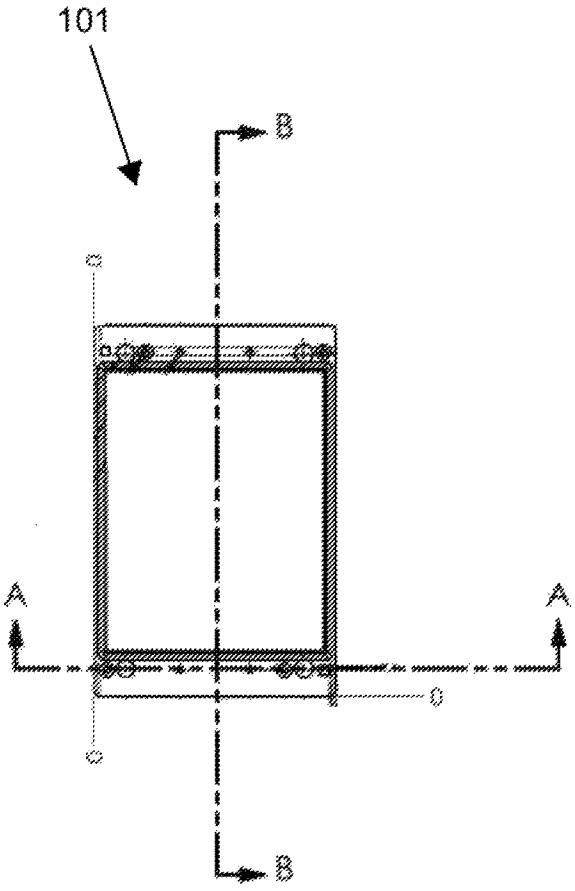
Figure 6C:
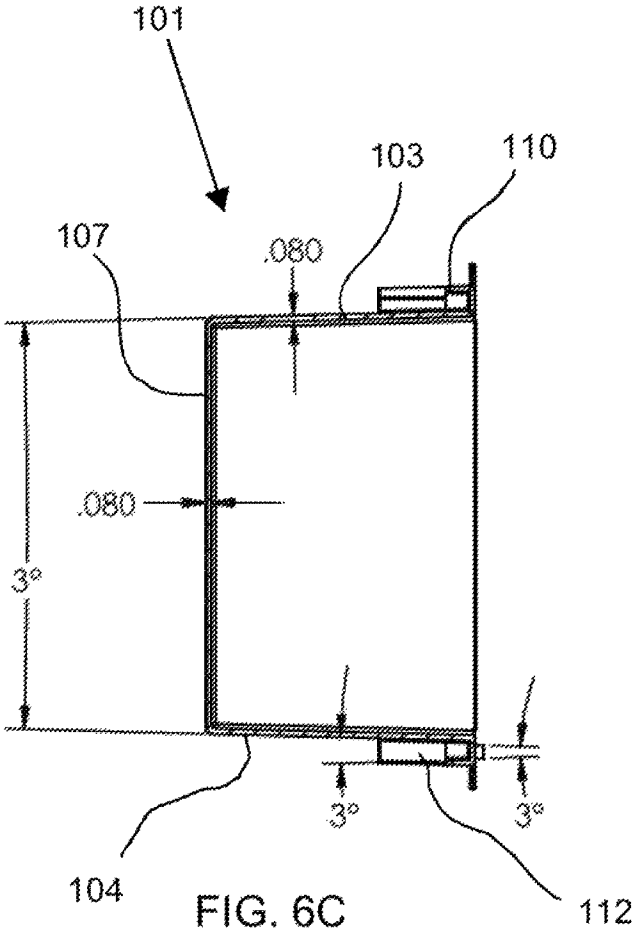
Figure 6F:
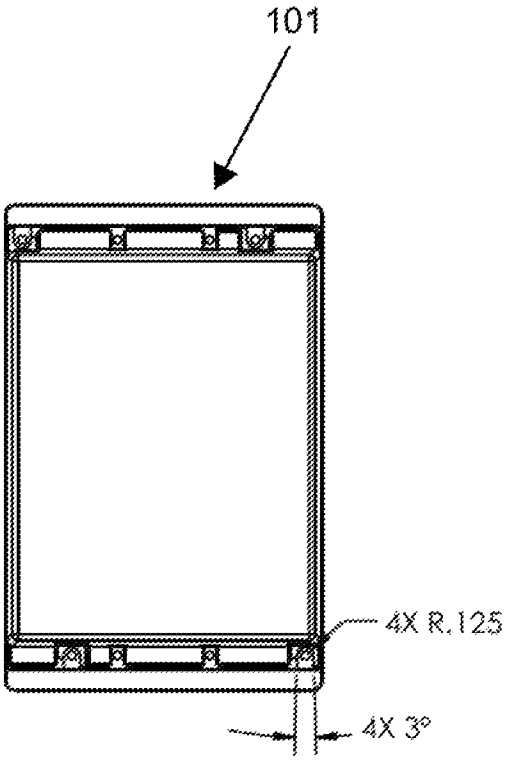
Figure 6E:
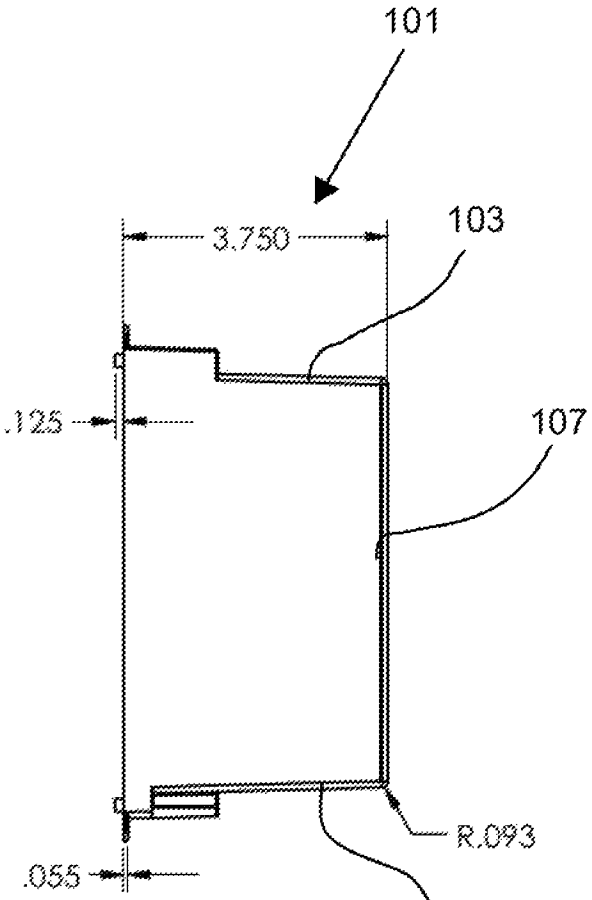
Figure 6G:
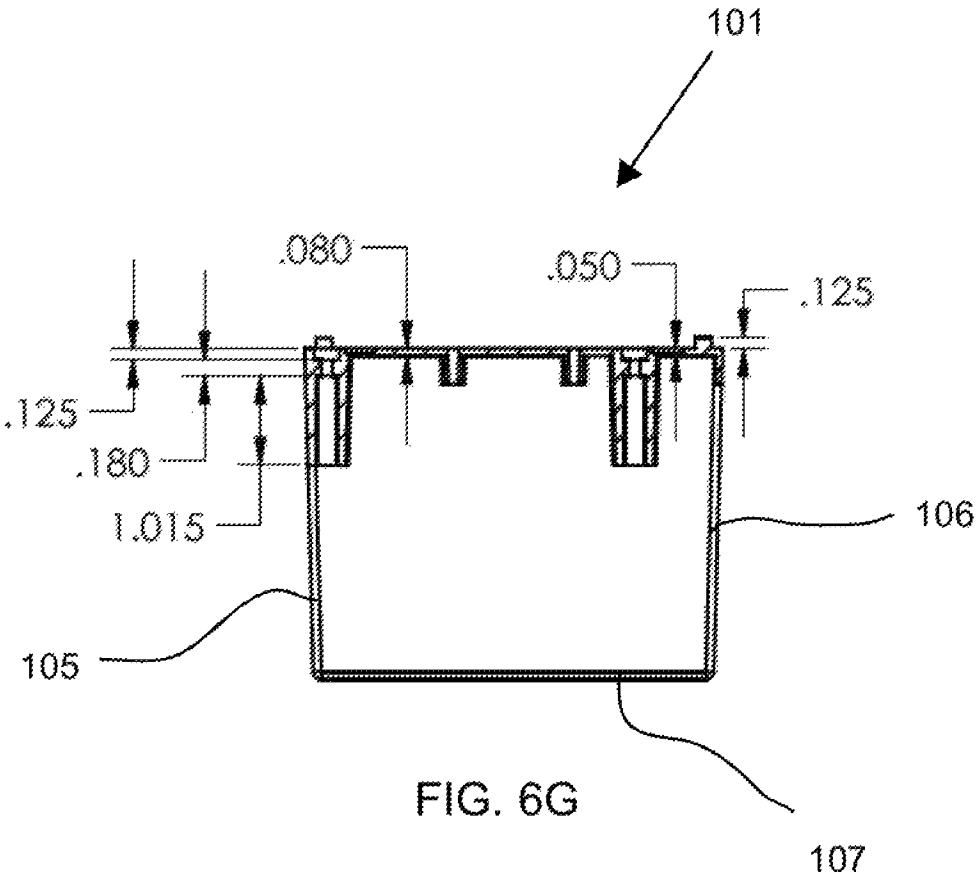

FIGS. 6A-6G illustrate various views of a tissue receptacle 101 according to the disclosure. FIG. 6A illustrates a top view of a tissue receptacle 101. A top side wall 103, a first screw tab 110, and a second screw tab 111 of the tissue receptacle are illustrated. FIG. 6B shows an isometric view of the tissue receptacle 101. The tissue receptacle 101 can comprise a first side wall 105, a second side wall 106, a back wall 107, a lower wall 104, and an upper wall 103. The tissue receptacle 101 can further comprise a first screw tab 110 a second screw tab 111, a third screw tab 112, and a fourth screw tab 113. FIG. 6C shows a cross-sectional side view of the tissue receptacle 101 taken along line B-B in FIG. 6D. FIG. 6D shows a front view of the tissue receptacle 101. FIG. 6E shows a side view of the tissue receptacle 101. FIG. 6F shows another front view of the tissue receptacle 101. FIG. 6G shows a cross-sectional bottom view of the tissue receptacle 101 taken along line A-A in FIG. 6D.

Figure 7A:
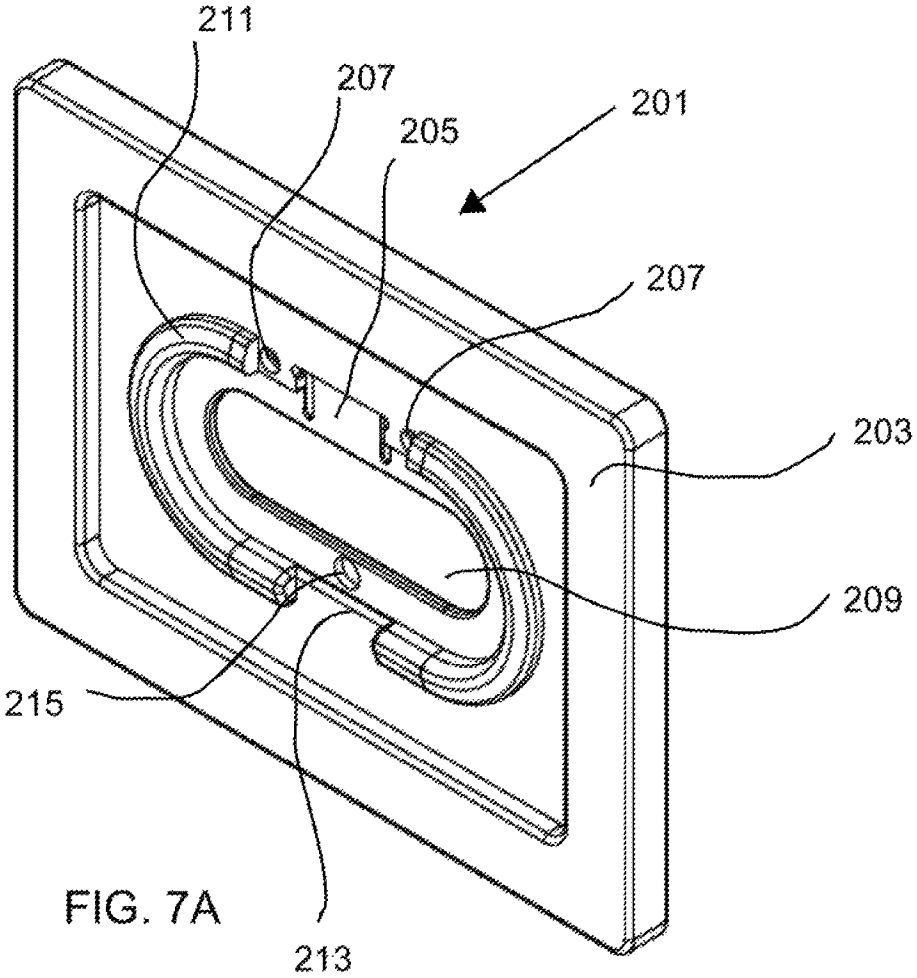
FIGS. 7A-7J are various views of an embodiment of a faceplate.

FIGS. 7A-7J depict various views of an embodiment of a faceplate 201. FIG. 7A shows an isometric view of a faceplate 201 comprising an outer band 203, a hinge receptacle 205, at least one hinge plate depression 207, a dispensing opening 209, a lid border 211, and a locking channel 213. The at least one hinge plate depression 207 can be positioned to allow a hinge plate (see FIGS. 9A-9E) to couple to the faceplate 201. The at least one hinge plate depression 207 can comprise a through-hole in the faceplate 201 or other mechanism to allow a hinge plate to securely couple to the faceplate 201. The hinge receptacle 205 can be sized and shaped to hold a hinge portion of a lid (see FIG. 8A-8H). The hinge receptacle 205 can interact with the hinge portion of a lid and a hinge plate to allow a lid to cover the dispensing opening 209 and be opened and closed by a user or other device. The lid border 211 can be a raised portion of the faceplate 201 that can be sized and shaped to surround an exterior border of a lid coupled to the faceplate 201. The dispensing opening 209 can comprise an opening that a wipe can be distributed through. In one embodiment the dispensing opening 209 can further comprise a cover as described above. In one embodiment, the cover can comprise a rubber material. In other embodiments, the cover can comprise other materials that allow a wipe to be pulled through the dispensing opening. In another embodiment, the dispensing opening can be free of any other materials and can allow a user to directly remove a wipe from inside an interior area. The locking channel 213 can comprise a space sized to fit a locking tab of a lid. The locking channel 213 can interact with the locking tab through a friction fit or other type of mechanism to secure the lid in a closed position. In on embodiment, the locking channel can further comprise a locking through-hole 215 to secure a protrusion from the lid to assist with securing the lid in a closed position against the faceplate.

Figure 7B:
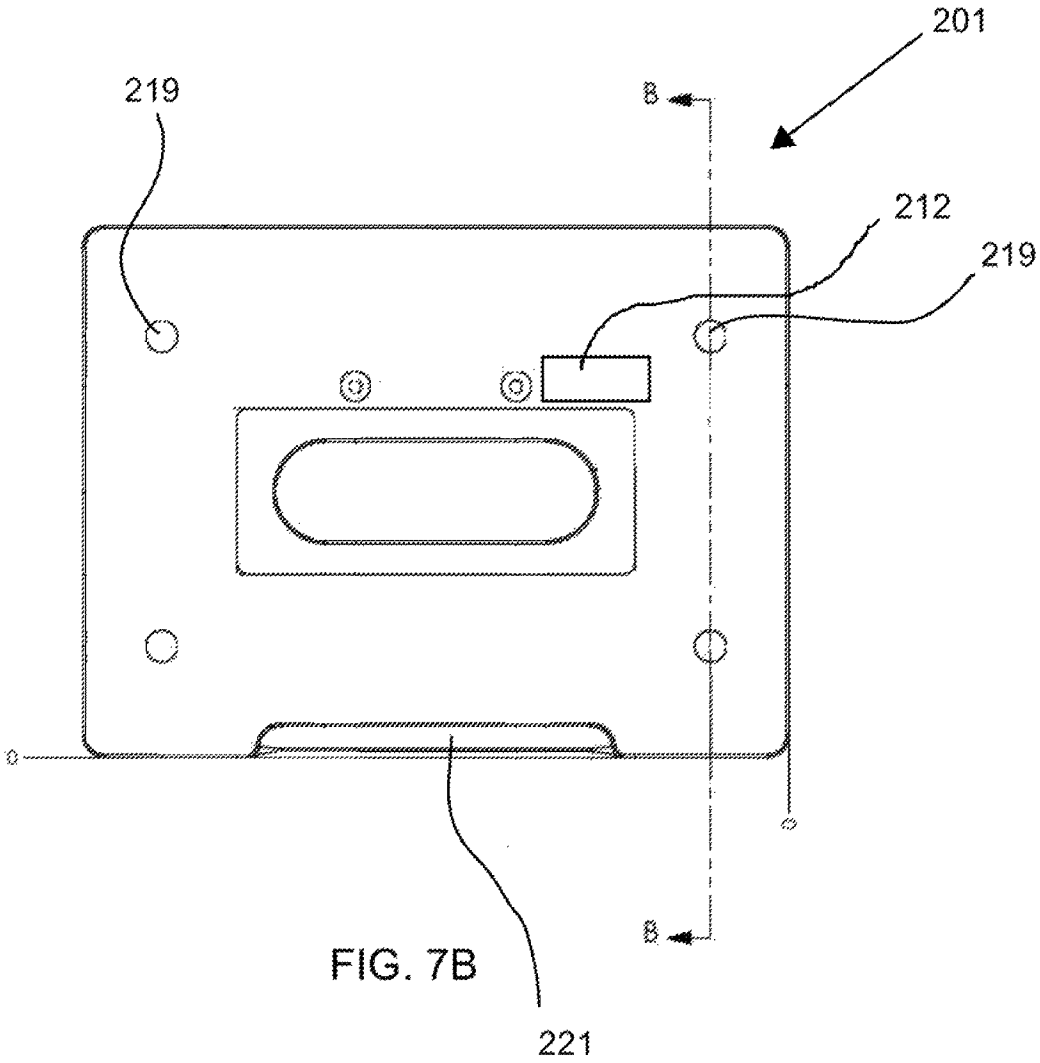
Figure 7D:
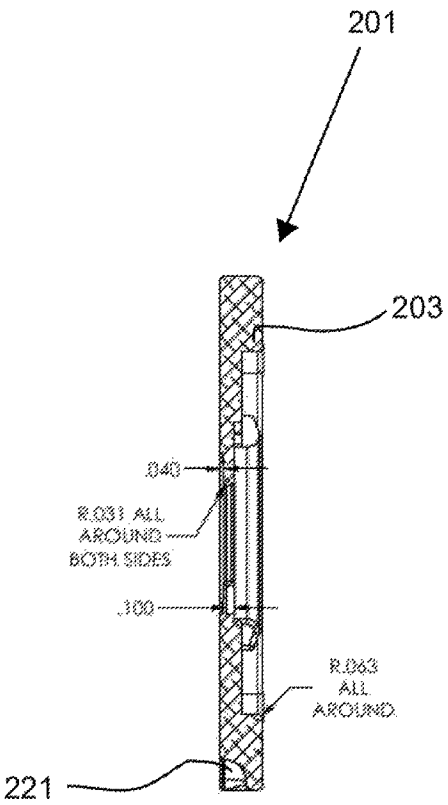
Figure 7C:
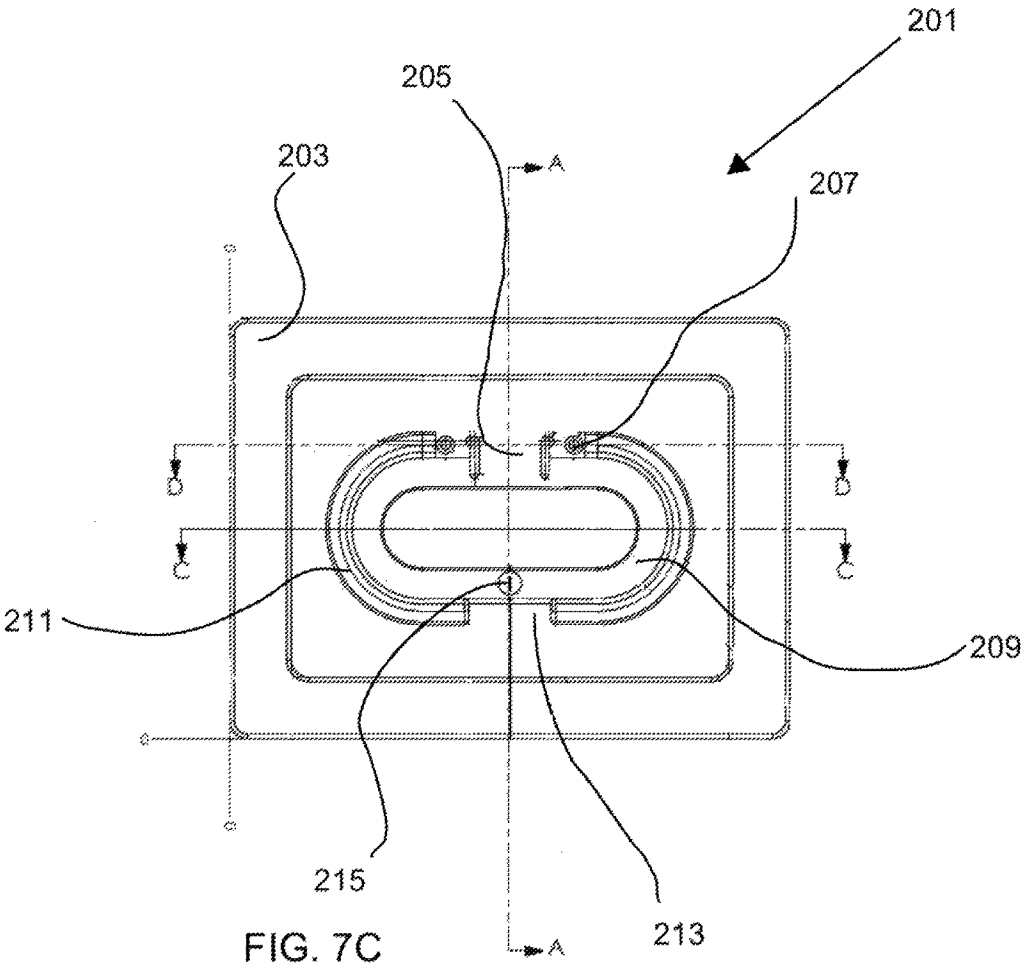
Figure 7G:
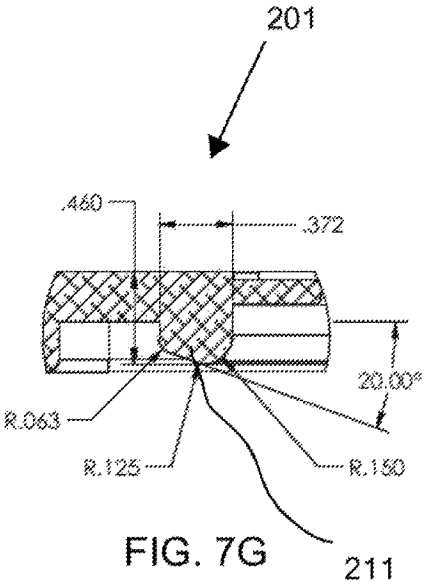
Figure 7E:
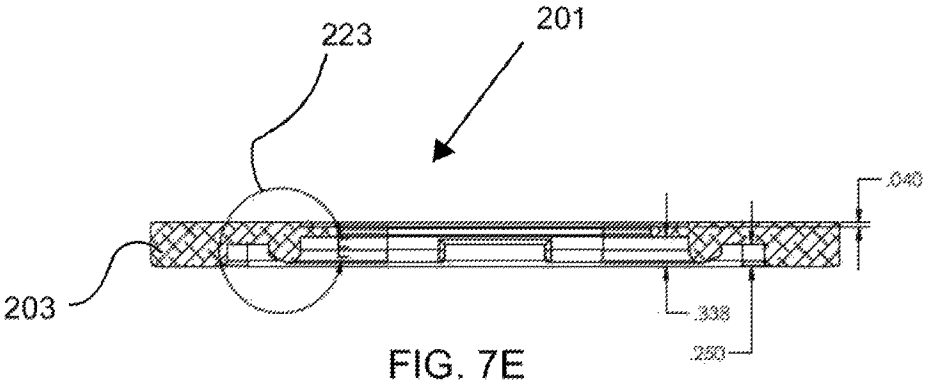
Figure 7F:
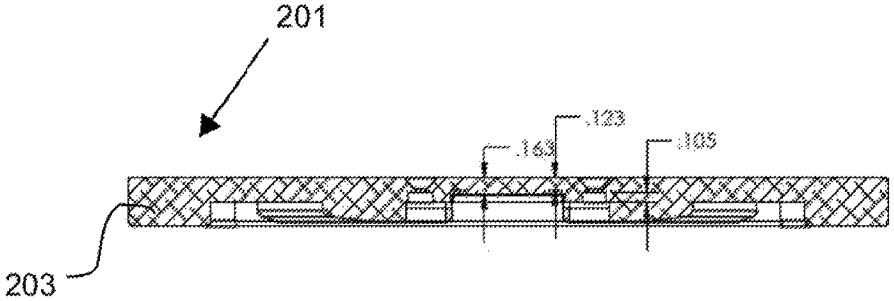
Figure 7J:
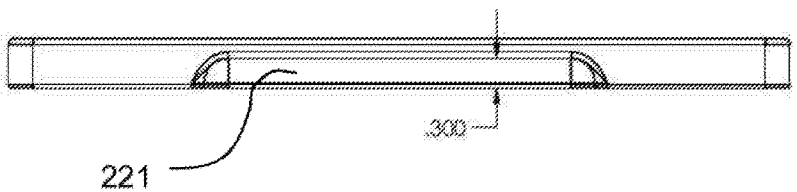
Figure 7I:
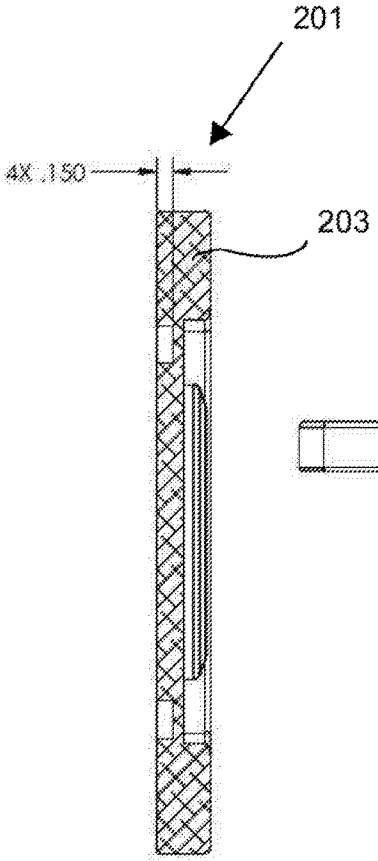
Figure 7H:
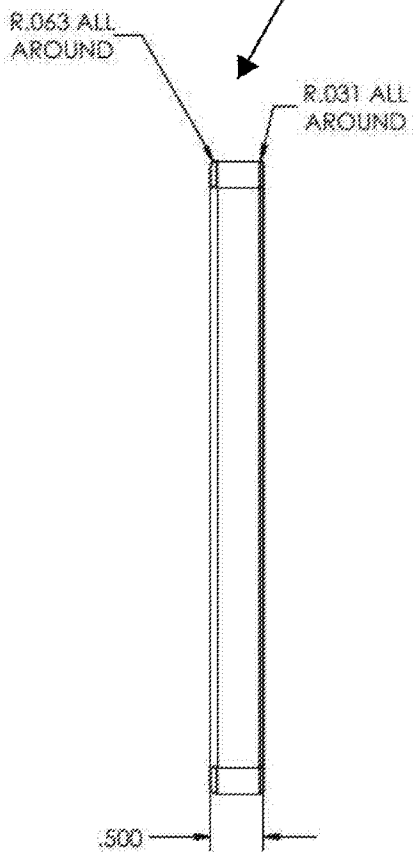

FIG. 7B illustrates a back view of the faceplate 201. The faceplate 201 can further comprise a plurality of first coupling members 219 and a hollow portion 221. The first coupling members 219 can be small portions of the faceplate 201 that are lowered in comparison to the surrounding portions of the faceplate 201 and sized and shaped to fit into projections from a tissue receptacle. The illustrated embodiment has four depressions that are circular in shape and deep enough to removably couple the faceplate 201 to a tissue receptacle. The hollow portion 221 can be used by a user to assist in removing the faceplate 201 from a tissue receptacle FIG. 7C is a front view of the faceplate 201 and shows several lead lines for cross-sectional views of the faceplate 201. FIG. 7D is a cross-sectional view of the faceplate 201 taken along line A-A of FIG. 7B. FIG. 7E is a cross-sectional view of the faceplate 201 taken along line C-C of FIG. 7B. FIG. 7F is a cross-sectional view of the faceplate 201 taken along line D-D of FIG. 7B. FIG. 7G is a blown up portion of the circular call-out 223 in FIG. 7E. FIG. 7H is a side view of the faceplate 201. FIG. 7I is a cross-sectional view of the faceplate 201 taken along line B-B in FIG. 7B. FIG. 7J is a bottom view of the faceplate 201. The faceplate 201 can comprise a hollow portion 221 that can be hidden from view when the faceplate is coupled to a tissue receptacle and adjacent a substrate. The hollow portion 221 can assist in removal of the faceplate 201 from a tissue receptacle.

In other embodiments, the faceplate can be coupled to the tissue receptacle in other manners. In one embodiment, the faceplate can be coupled to the tissue receptacle by a hinge. The hinge can be opened if a user wants to access an area behind the faceplate. In other embodiments, the faceplate can slide on a channel to couple to a tissue receptacle. In one embodiment, the tissue receptacle can comprise a raised channel that can fit within a depression of the faceplate. In another embodiment, the faceplate can comprise a raised channel that can fit within a depression of the tissue receptacle. In another embodiment, a toilet paper roll can be coupled to a front face of the dispenser.

Figure 8B:
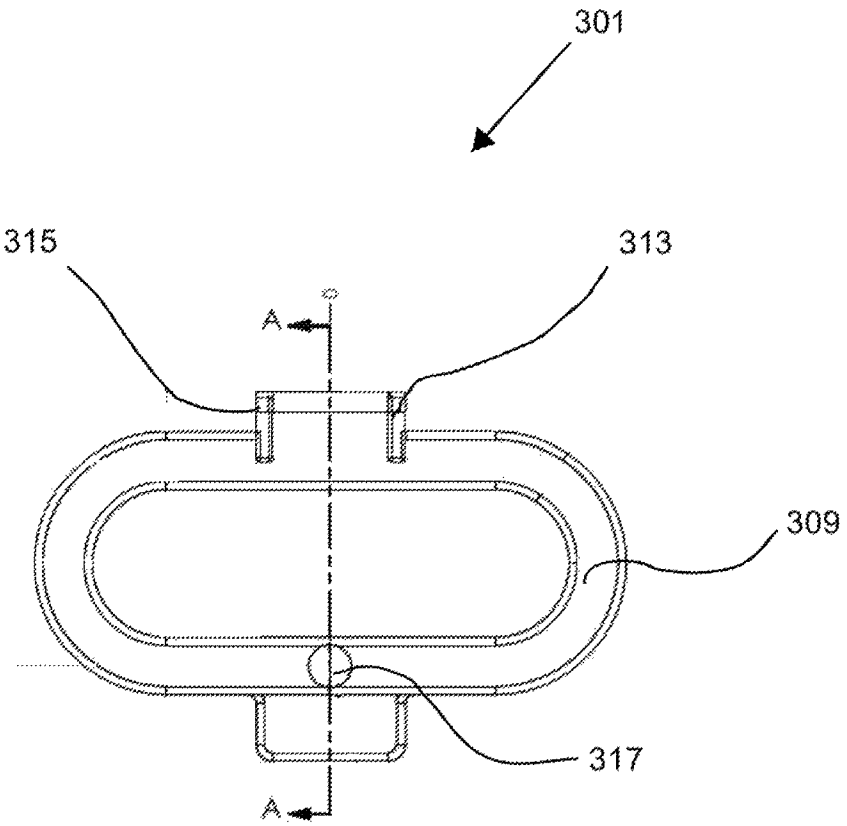
FIGS. 8A-8H are various views of an embodiment of a lid.
Figure 8A:
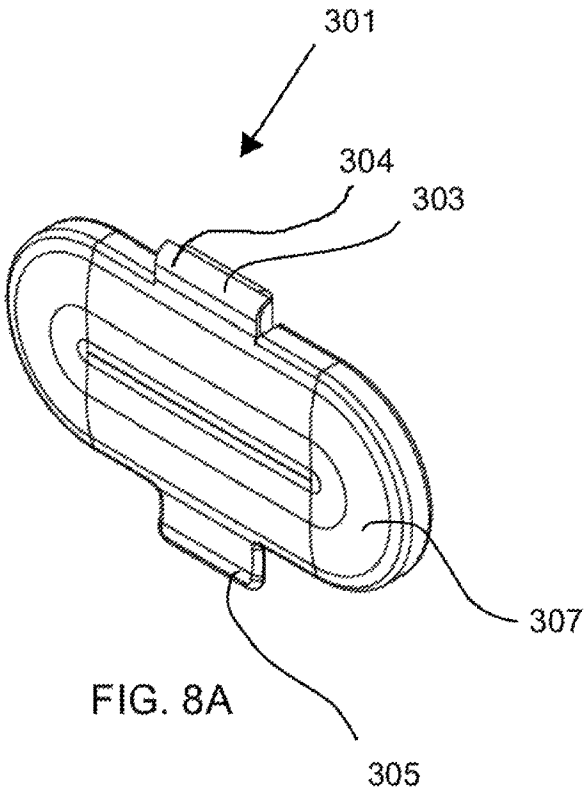
Figure 8D:
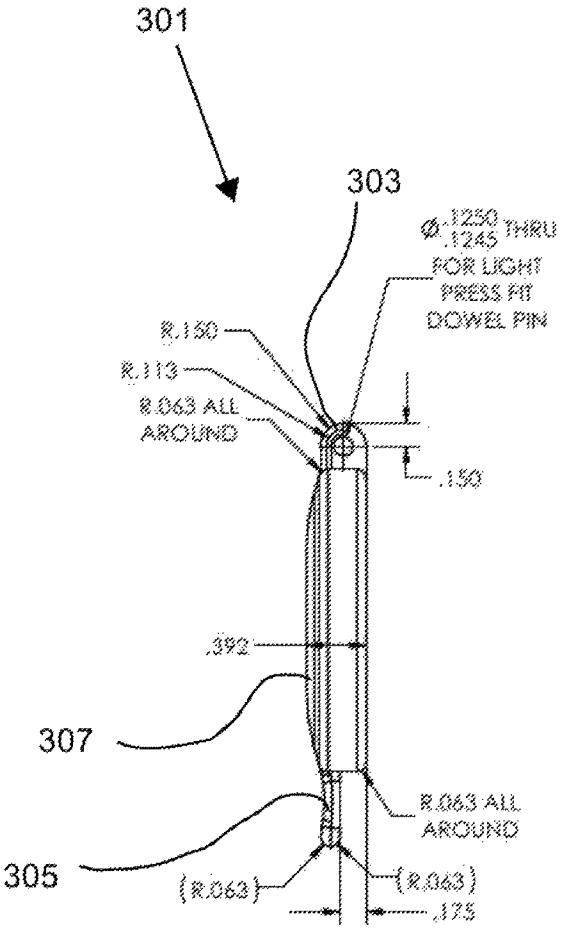
Figure 8C:
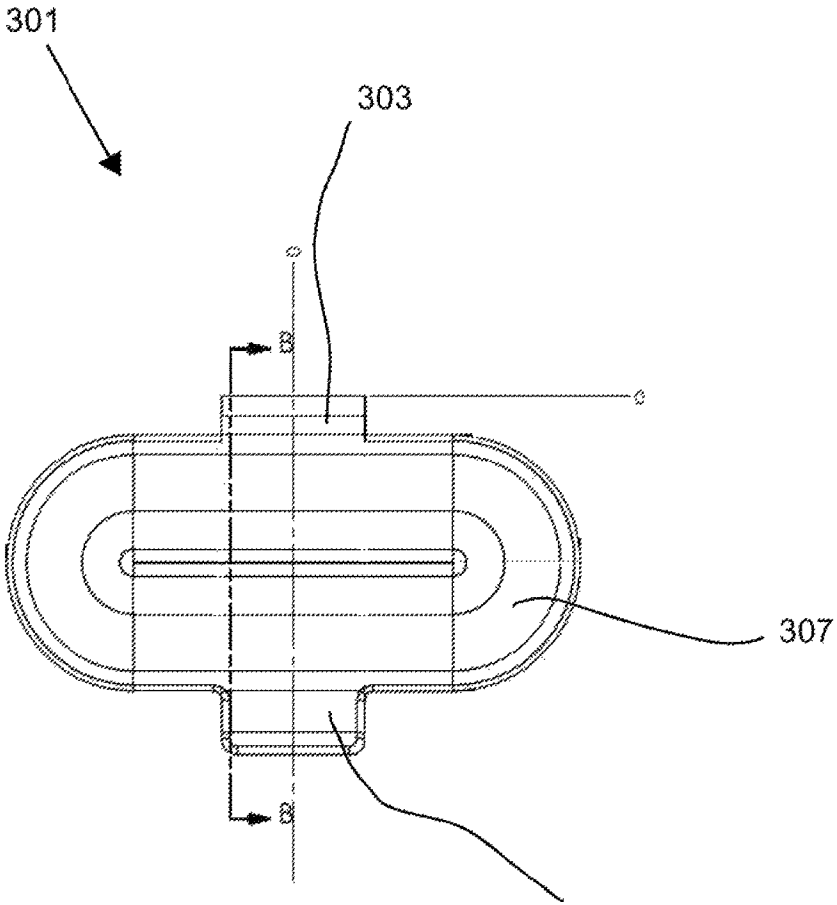
Figure 8E:
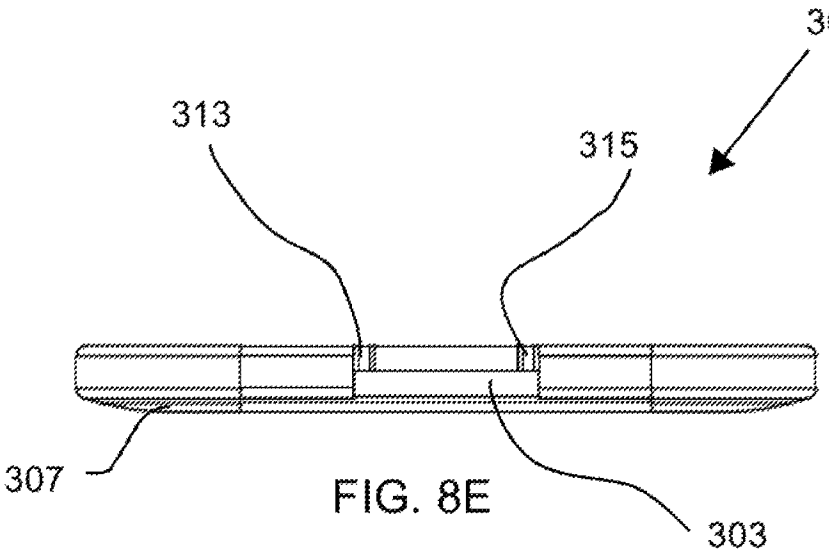
Figure 8F:
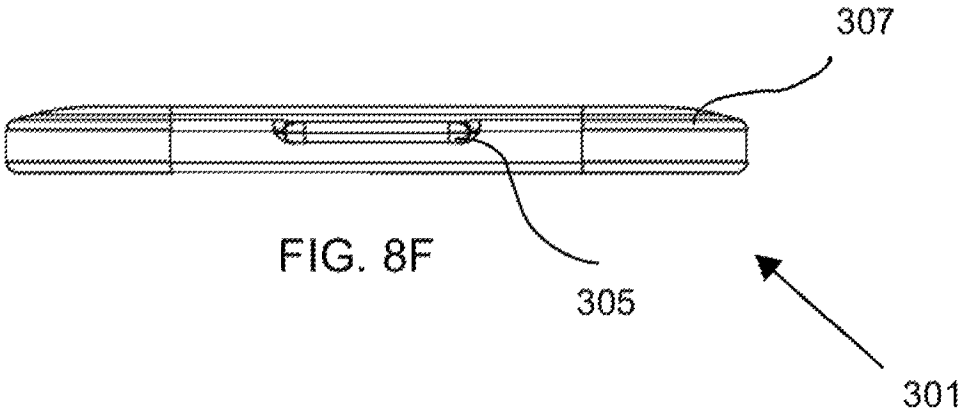
Figure 8H:
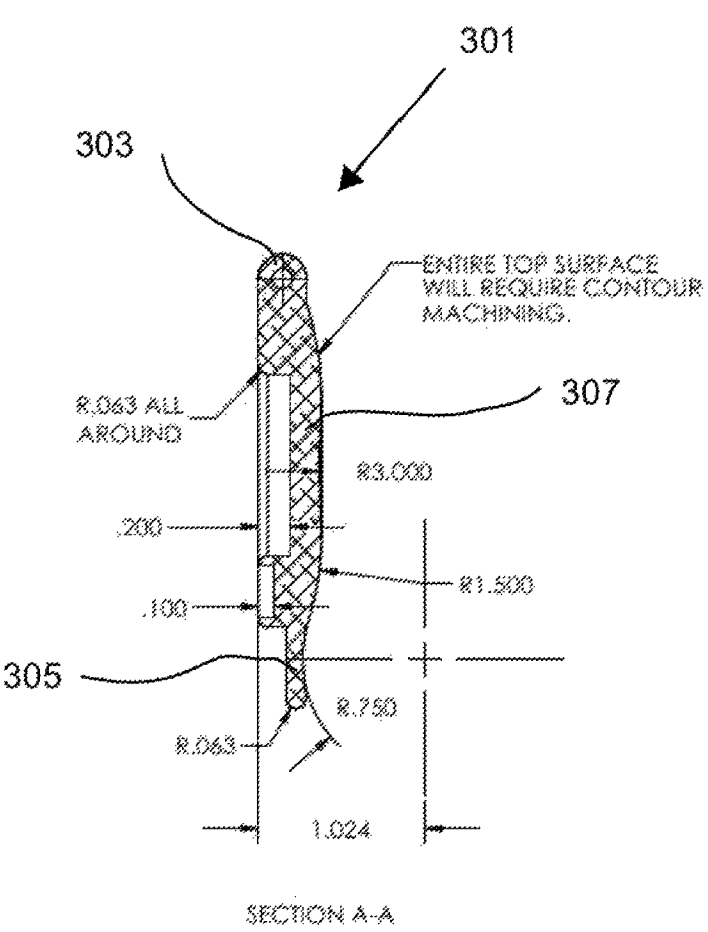
Figure 8G:
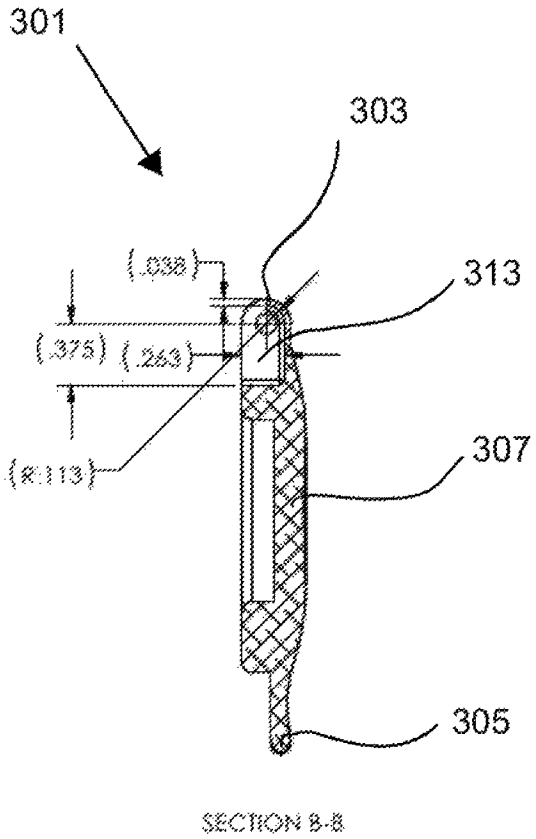

FIGS. 8A-8H depict various views of an embodiment of a lid 301. The lid 301 can comprise a hinge portion 303, a handle tab 305, a front face 307, and a back face 309. The hinge portion 303 can be configured to releaseably couple to a faceplate and a hinge plate as described above. The hinge portion 303 can further comprise at least one hinge depression. The at least one hinge depression can assist releaseably coupling the lid to a hinge plate. In the illustrated embodiment a first hinge depression 313 is on a first side of the hinge portion 303 and a second hinge depression 315 is on a second opposing side of the hinge portion 303. The handle tab 305 can be sized and shaped to fit within the hinge receptacle as seen in FIGS. 7A-7J. The handle tab 305 can comprise a lower portion that is raised from the faceplate when the lid is coupled to the faceplate and in the closed position. In some embodiments, the handle tab can form a friction fit with the faceplate to keep the lid releaseably secured to the faceplate. In the illustrated embodiment, the lid 301 further comprises a locking recession 317 that can be coupled with a protrusion present on a faceplate. In some embodiments, the faceplate can contain a separate depression or through-hole and the apparatus can further comprise a plug that can be secured to the faceplate and interact with the lid. The plug can comprise a variety of materials to allow a friction or stress fit between the lid and the faceplate. FIG. 8A depicts an isometric front view of the lid 301. FIG. 8B shows a rear view of the lid 301. FIG. 8C shows a front view of the lid 301. FIG. 8D shows a side view of the lid 301. FIG. 8E shows a top view of the lid 301. FIG. 8F shows a bottom view of the lid 301. FIG. 8G shows a cross-sectional view of the lid 301 taken along line B-B in FIG. 8C. FIG. 8H shows a cross-sectional view of the lid 301 taken along line A-A in FIG. 8B.

Figures 9A, 9B:
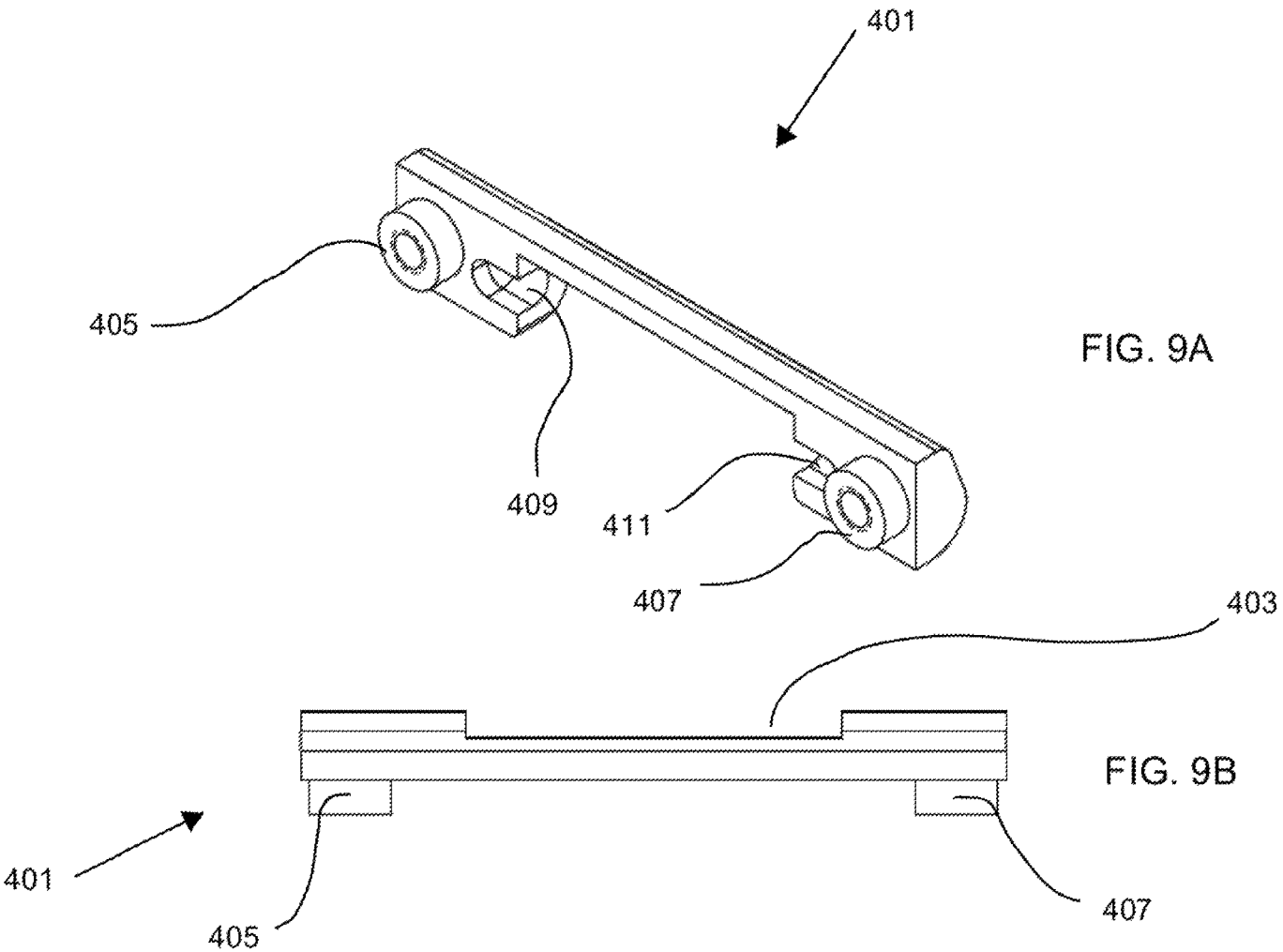
FIGS. 9A-9E are various views of an embodiment of a hinge plate.
Figure 9C:
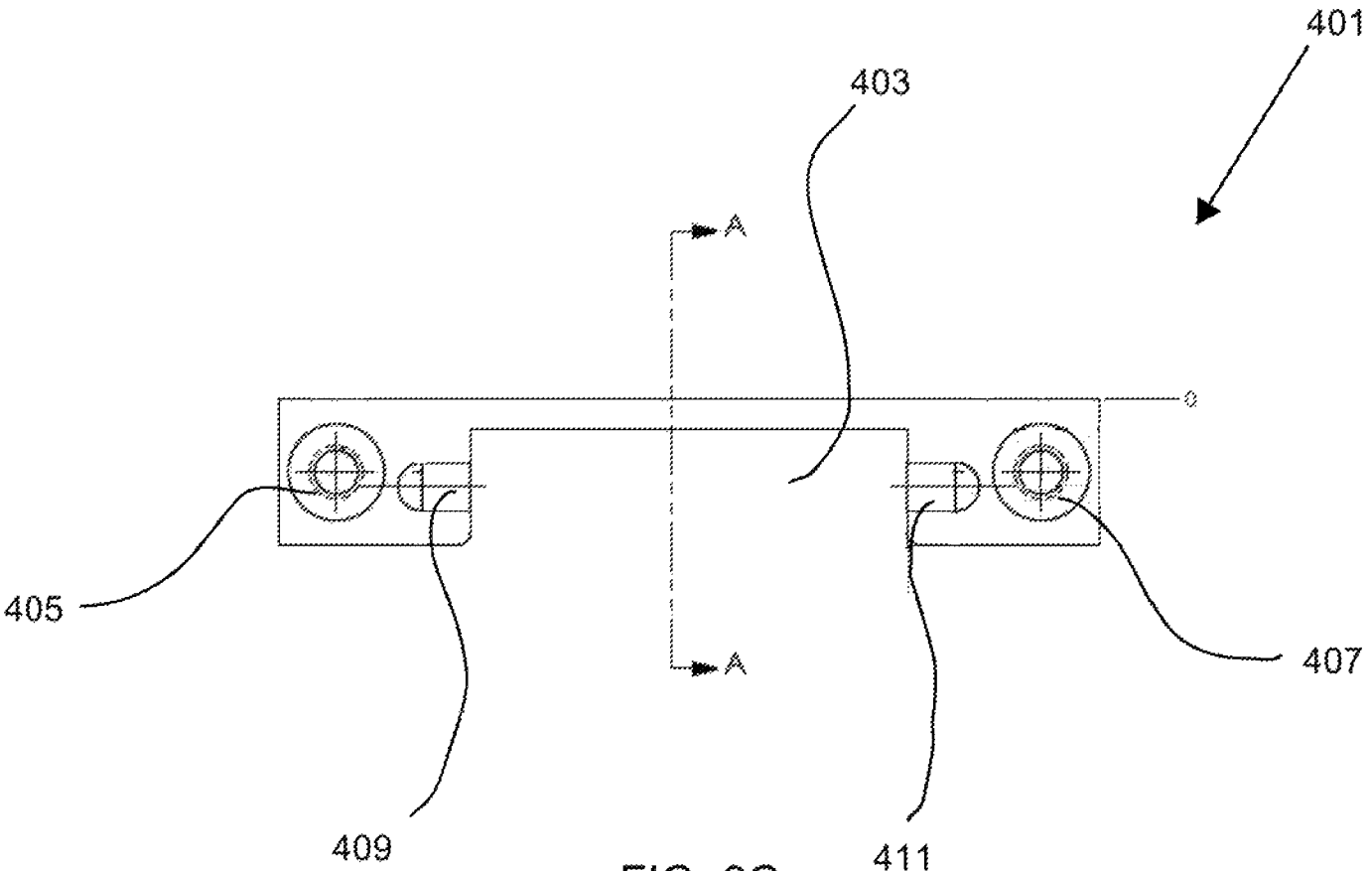
Figure 9E:
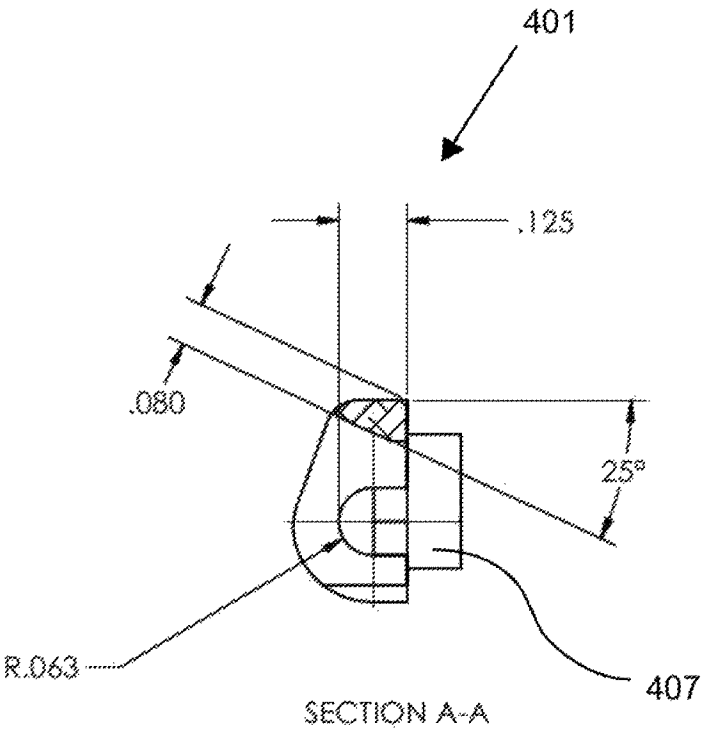
Figure 9D:
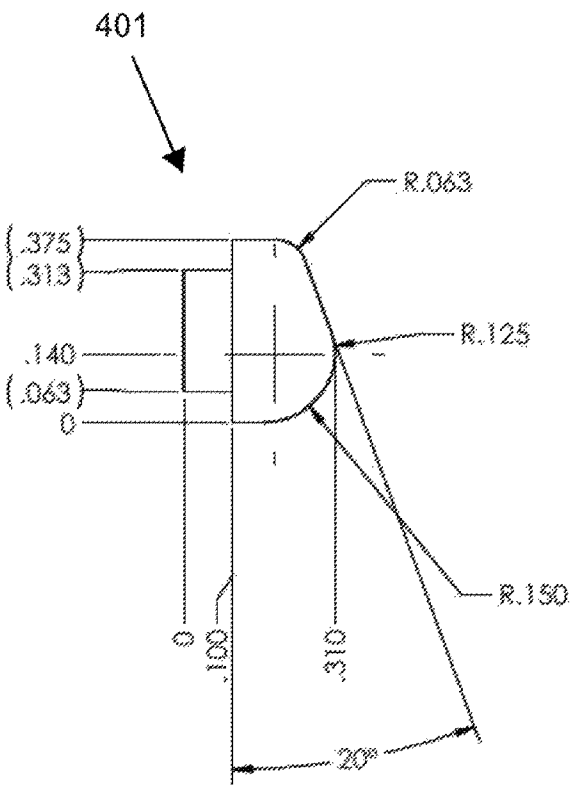

FIGS. 9A-9E depict various views of a hinge plate 401. FIG. 9A shows an isometric back view of a hinge plate 401. The hinge plate 401 can comprise a hinge opening 403, a first hinge plate protrusion 405, a second hinge plate protrusion 407, a first hinge plate depression 409, and a second hinge plate depression 411. The hinge opening 403 can be as wide as the hinge portion of the lid described above. The hinge opening 403 can allow the lid to freely open and close while the hinge plate couples the lid to the faceplate. The first hinge plate protrusion 405 and the second hinge plate protrusion 407 can be coupled with matching depressions in the faceplate described above. The first and second hinge plate protrusions can be configured to couple with a friction fit to the faceplate. The first hinge plate depression 409 and the second hinge plate depression 411 can be coupled with a first hinge plug and a second hinge plug (not shown). The first hinge plug can be fitted within the first hinge plate depression 409 and can be used to couple the first hinge plate depression 409 and the first hinge depression as shown in FIG. 8B. The second hinge plug can be fitted within the second hinge plate depression 411 and can be used to couple the second hinge plate depression 411 and the second hinge depression as shown in FIG. 8B. In other embodiments the first and second hinge plate depressions can be replaced with protrusions that can interact with the hinge portion of the lid without the need of a plug. FIG. 9B shows a top view of the hinge plate 401. FIG. 9C shows a back view of the hinge plate 401. FIG. 9D shows a side view of the hinge plate 401. FIG. 9E shows a cross-sectional view of the hinge plate 401 taken along line A-A in FIG. 9C.

Figure 10B:
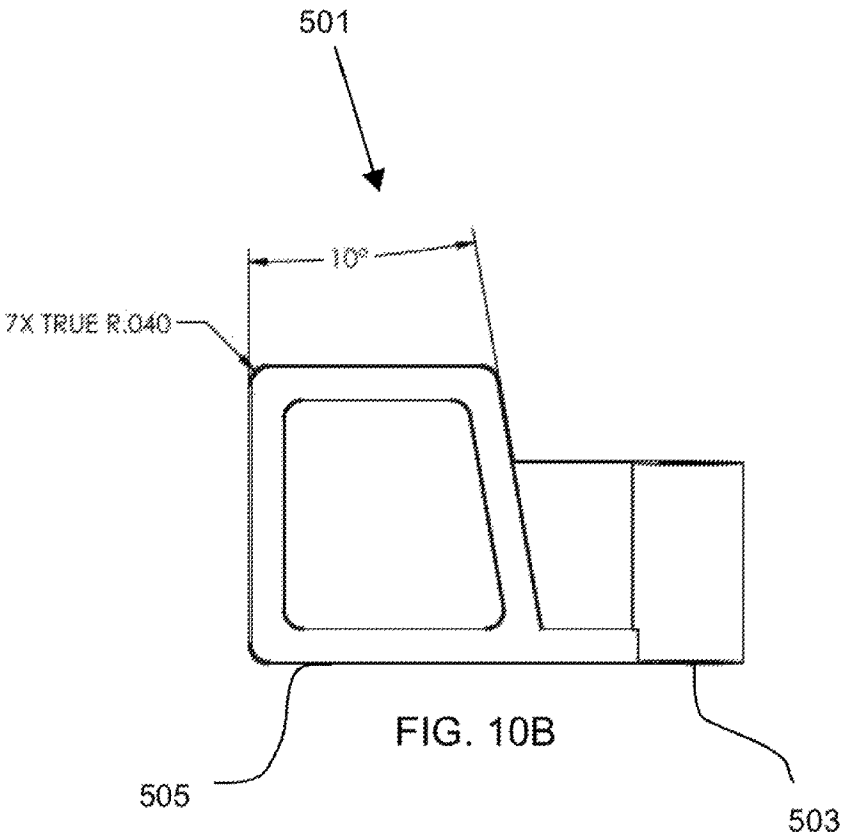
FIGS. 10A-10G are various views of an embodiment of a box tab.
Figure 10A:
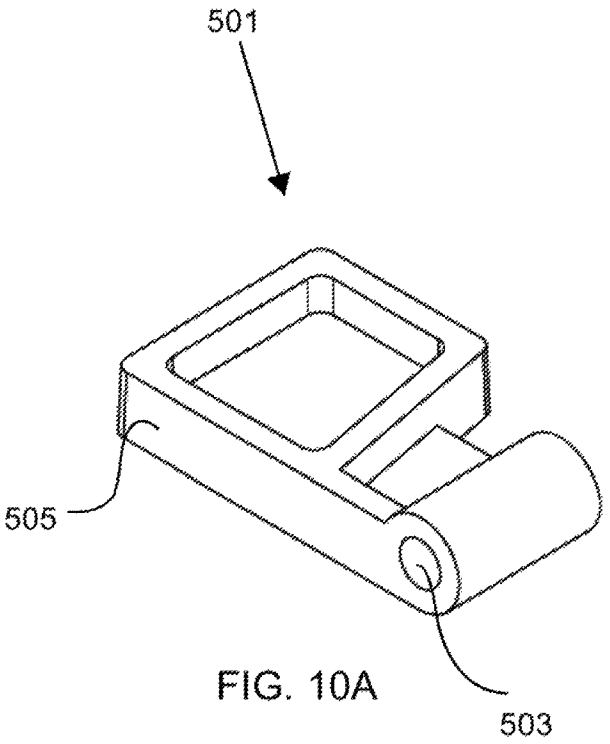
Figure 10D:
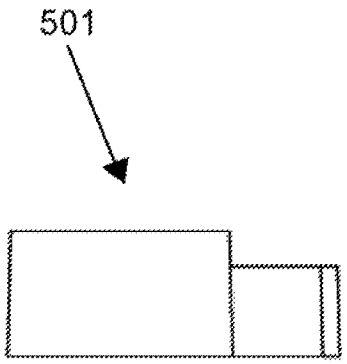
Figure 10C:
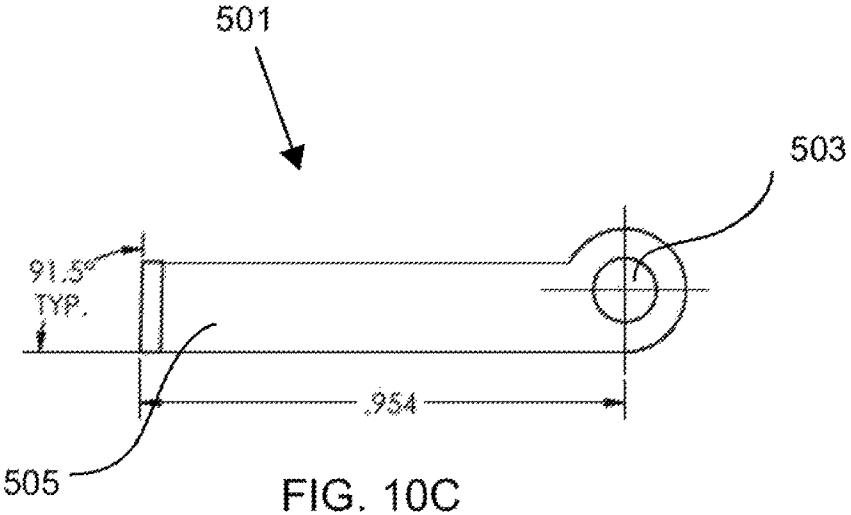
Figure 10E:
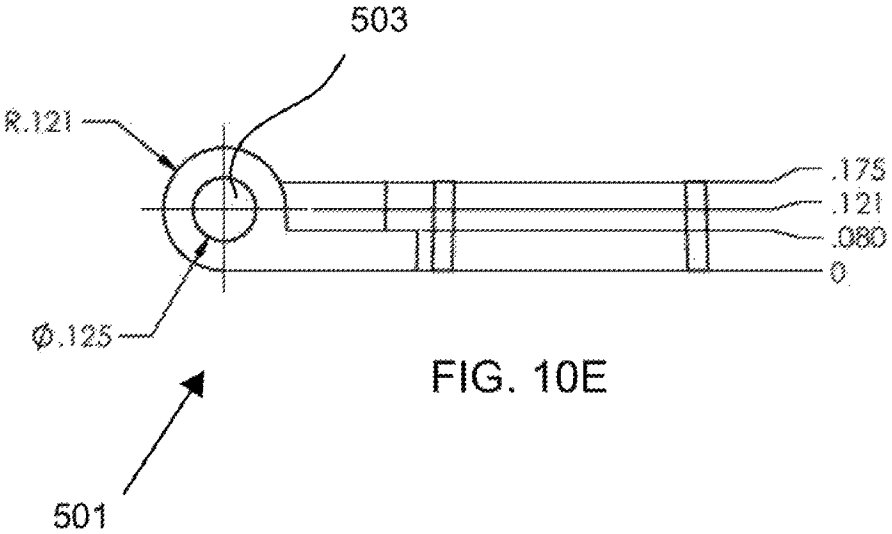
Figure 10G:
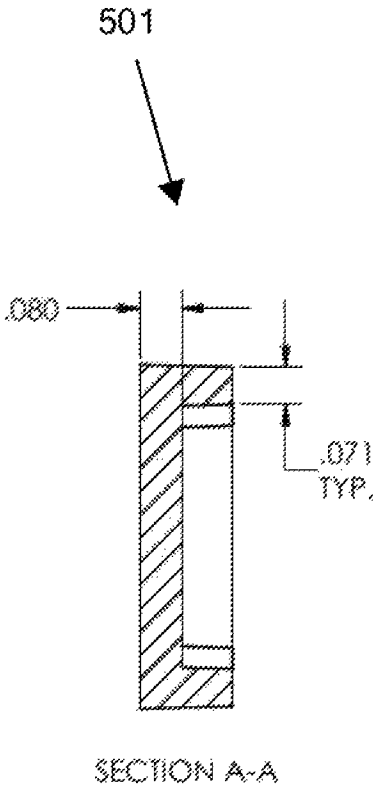
Figure 10F:
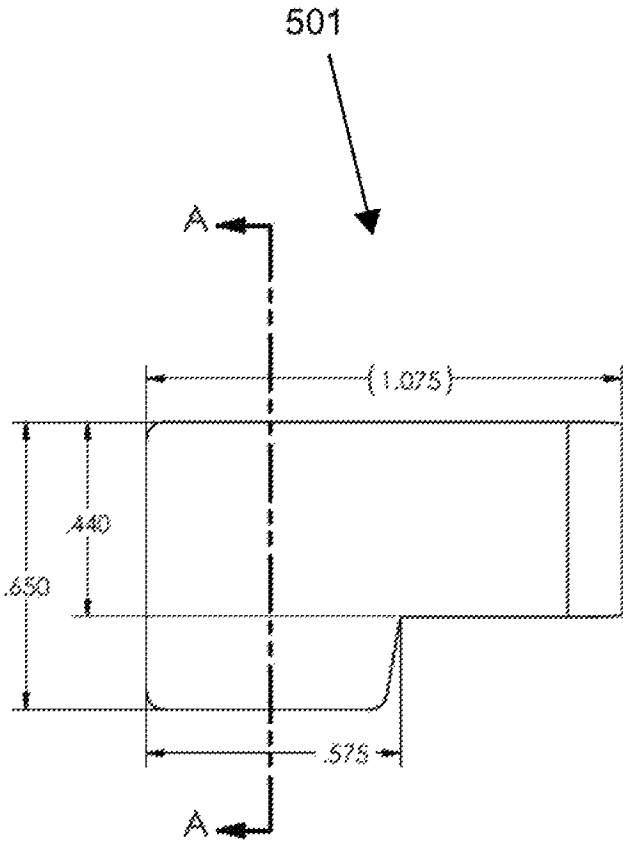

FIGS. 10A-10G depict various views of a box tab 501 that can be used to secure a tissue dispenser to a substrate. The box tab 501 can comprise a screw hole 503 and a securing face 505. The screw hole 503 can be used to couple the box tab 501 to the tissue receptacle and the securing face 505 can interact with a substrate and as a screw is tightened within the screw hole 503 the securing face 505 can brace against the substrate to secure the tissue receptacle to the substrate. FIG. 10A is an isometric front view of the box tab 501. FIG. 10B is a top view of the box tab 501. FIG. 10C is a front view of the box tab 501. FIG. 10D is a right side view of the box tab 501. FIG. 10E is a back view of the box tab 501. FIG. 10F is a left side view of the box tab 501. FIG. 10G is a cross-sectional view of the box tab 501 taken along line A-A in FIG. 10F.

Figure 11:
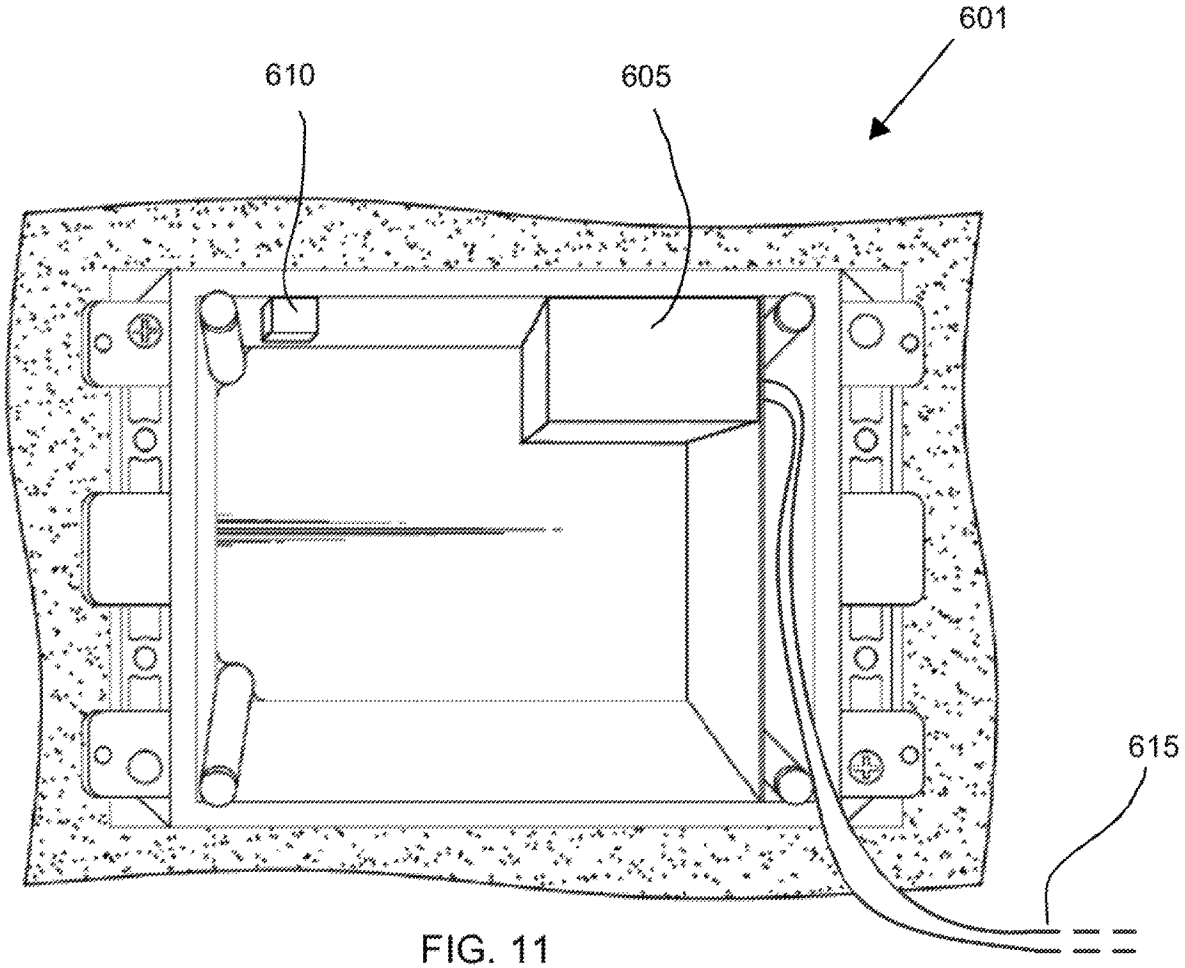
FIG. 11 is a front view of another embodiment of a tissue receptacle.

FIG. 11 illustrates another embodiment of a tissue receptacle 601 that further comprises a heater 605, a motion sensor 610, and an electrical connection 615. The heater 605 can heat a wipe before the wipe is removed. The heater 605 can comprise a resistive heater, an infrared heater, a radiant heater, or the like. While the heater 605 in the illustrated embodiment is depicted in an upper right corner of the tissue receptacle 601, this placement is not required. The heater 605 can be located in various locations depending on the desired function of the heater 605. In other embodiments the heater may be in front of any wipes that are present in the tissue receptacle to direct heat towards those wipes that will be first removed from the tissue receptacle by a user. In other embodiments, one or more of the walls of the tissue receptacle may comprise, in part or in whole, a material with a higher degree of thermal conduction than the surrounding areas. The area with higher thermal conduction can be used to more efficiently heat the wipes or the entirety of the tissue receptacle. In one embodiment, the area with higher thermal conductivity can be coupled with the heater. In another embodiment, the heater can comprise a thermally conductive portion that can contact one or more wipes in the tissue receptacle. The thermally conductive portion can conform to a wall of the tissue receptacle. In one embodiment, the thermally conductive portion can lay on at least in part on a lower wall of the tissue receptacle and tissues can be positioned on top of the thermally conductive portion. In another embodiment, the thermally conductive portion can be placed in front of the wipes and the thermally conductive portion can warm the front most tissues before warming those tissues further towards the back of the tissue receptacle. In yet other embodiments, multiple walls of the tissue receptacle can comprise a heater. In this embodiment a resistive or other type heater can be integrated into multiple walls of the tissue receptacle. In one such embodiment, a resistive heater can be in contact with the top wall, the bottom wall, the left wall, the right wall, and the back wall. This arrangement can allow for a more even distribution of temperature throughout the tissue receptacle. In one embodiment, the tissue receptacle can be insulated to conserve heat loss to surrounding areas. The insulated portions of the tissue receptacle can comprise a lower thermal conductivity than non-insulated areas of the tissue receptacle. In another embodiment, the heater can further comprise a temperature probe. The temperature probe can monitor the temperature of the heater or the area surrounding the heater and can activate or turn off the heater at pre-determined temperatures. In one embodiment, the shut-off temperature or heater activation temperature can be chosen by a user to fit within their desired temperature range.

The motion sensor 610 can be mounted in the tissue receptacle 601 and can be placed so that a front portion of the motion sensor can interact with an open space of a faceplate to allow for the motion sensor 610 to detect movement outside of the faceplate. In one embodiment, the motion sensor 610 can communicate with the heater 605. In such embodiments, the heater 605 can be programmed to heat a wipe when motion is sensed outside the dispenser. The motion sensor 610 can save on energy costs of heating the wipes and result in less excess energy being directed into the surrounding environment. In another embodiment, the motion sensor can be integrated into a faceplate that can be mounted on the tissue receptacle. The motion sensor can be separately powered or connected to a power source within the tissue receptacle. The electrical connection 615 can be configured to exit a front portion of a faceplate and be plugged in to an existing electrical outlet. While FIG. 11 shows the electrical connection 615 with the heater 605 and the motion sensor 610, it is not necessary that the electrical connection be present with either or both of these components. In one embodiment, the electrical connection can only operate the heater and no other components need be present. In other embodiments, the electrical connection can only operate other specific or groups of components and no other specific component needs be present. Other possible components that can be present within the tissue receptacle include lights of various colors and luminosity.

Figure 12A:
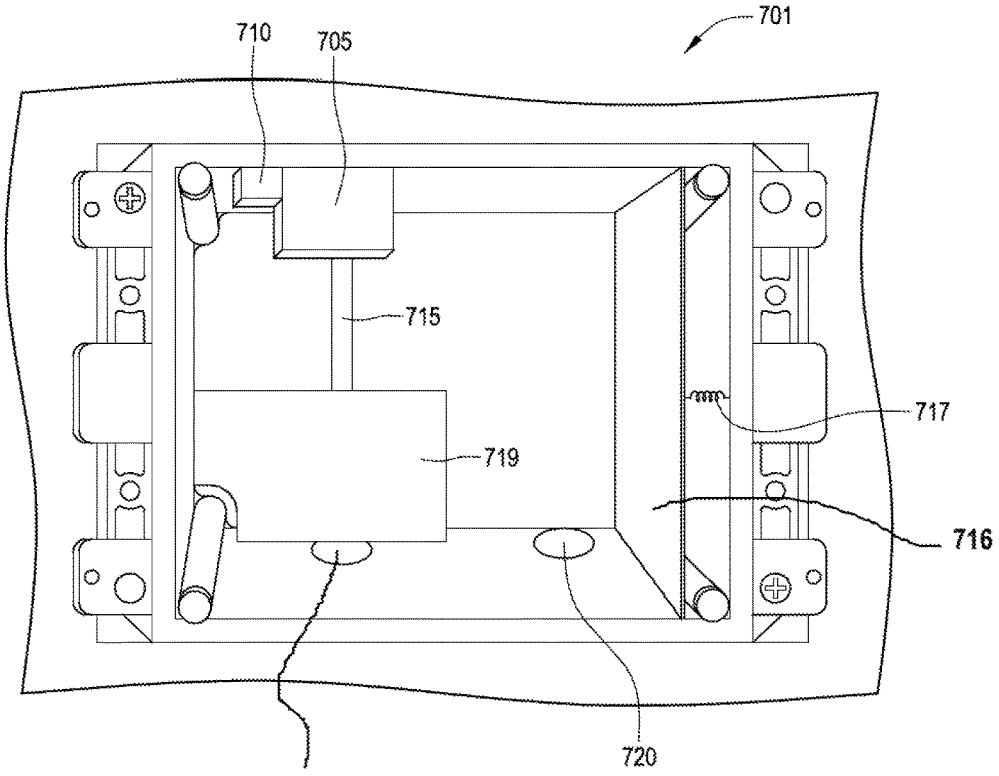
FIGS. 12A and 12B are a front view and a cross-sectional top view of another embodiment of a tissue receptacle.
Figure 12B:
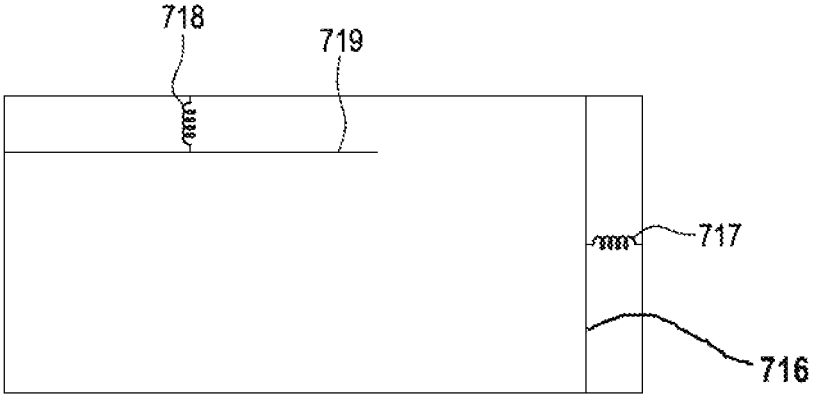

FIGS. 12A and 12B depict another embodiment of a tissue receptacle 701. The tissue receptacle 701 can comprise a first divider 716, a first spring 717, a wire receiving through-hole 720, an electrical connection 715, a heater 705, and a motion sensor 70. The wire receiving through-hole 720 can allow the tissue receptacle 701 to be connected to an electrical connection 715. In one embodiment, the wire receiving through-hole can allow for the tissue receptacle to be connected to a buildings power supply. The electrical connection to the power supply can run various components of the tissue receptacle including a heater, motion sensor, automatic opener, etc. While FIG. 12A shows the electrical connection 715 with the heater 705 and the motion sensor 10, it is not necessary that the electrical connection 715 be present with either or both of these components. In one embodiment, the electrical connection can only operate the heater and no other components need be present. In other embodiments, the electrical connection can only operate other specific or groups of components and no other specific component needs be present. The first spring 717 can be coupled to a wall of the tissue receptacle and to the first divider 716.

Figure 13:
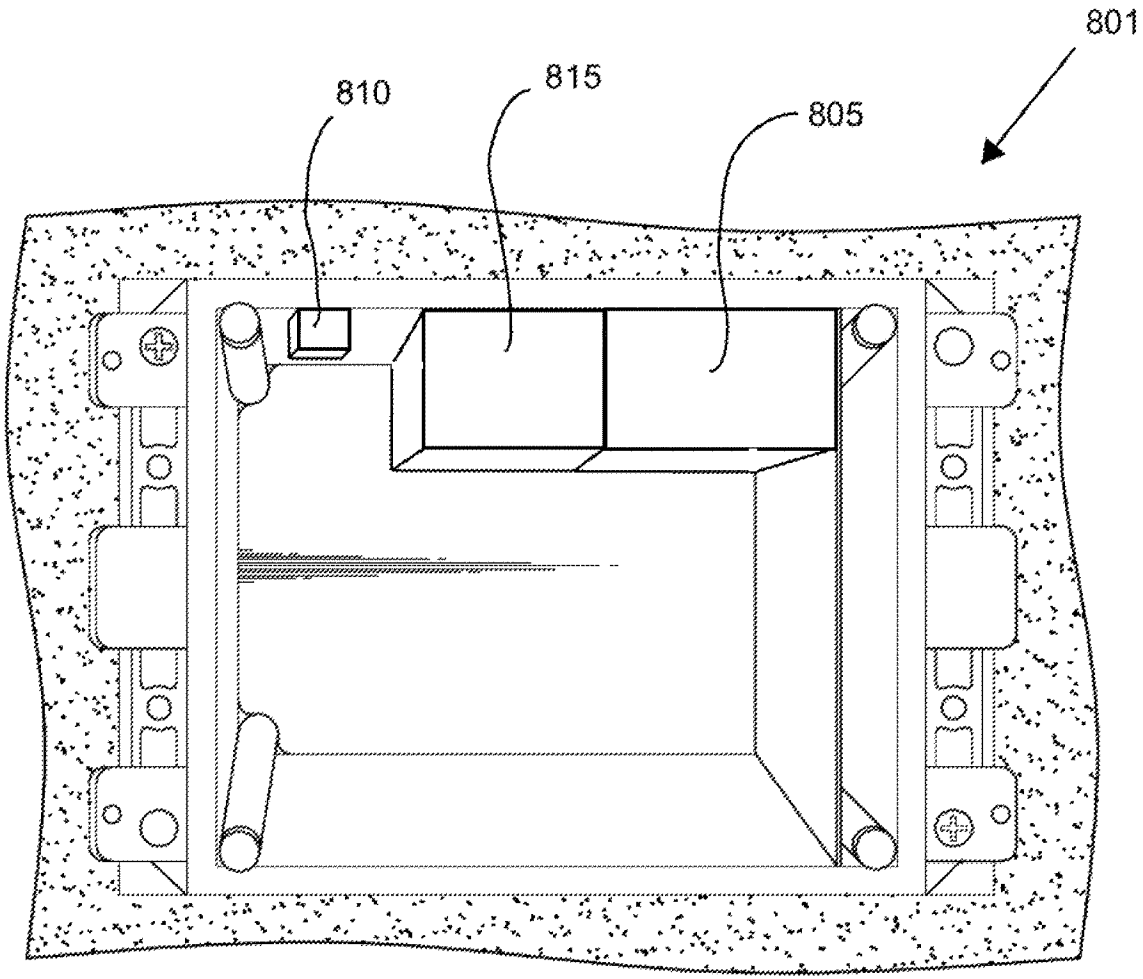
FIG. 13 is a front view of another embodiment of a tissue receptacle.

FIG. 13 depicts another embodiment of a tissue receptacle 801. The tissue receptacle 801 can comprise a heater 805, a motion sensor 810, and a battery 815. The battery 815 can be used to run various components of the tissue receptacle 801 including the heater 805, the motion sensor 810, an automatic opener, etc. In one embodiment, the battery is a rechargeable battery and when the battery is low a user can remove the battery, recharge the battery, and place the battery back in the tissue receptacle 801. While FIG. 13 shows the battery 815 with the heater 805 and the motion sensor 810, it is not necessary that the rechargeable battery 815 be present with either or both of these components. In one embodiment, the battery can only operate the heater and no other components need be present. In other embodiments, the battery can only operate other specific or groups of components and no other specific component needs be present. In yet other embodiments, the battery can be a non-rechargeable battery and the battery can be replaced when depleted.

Figure 14:
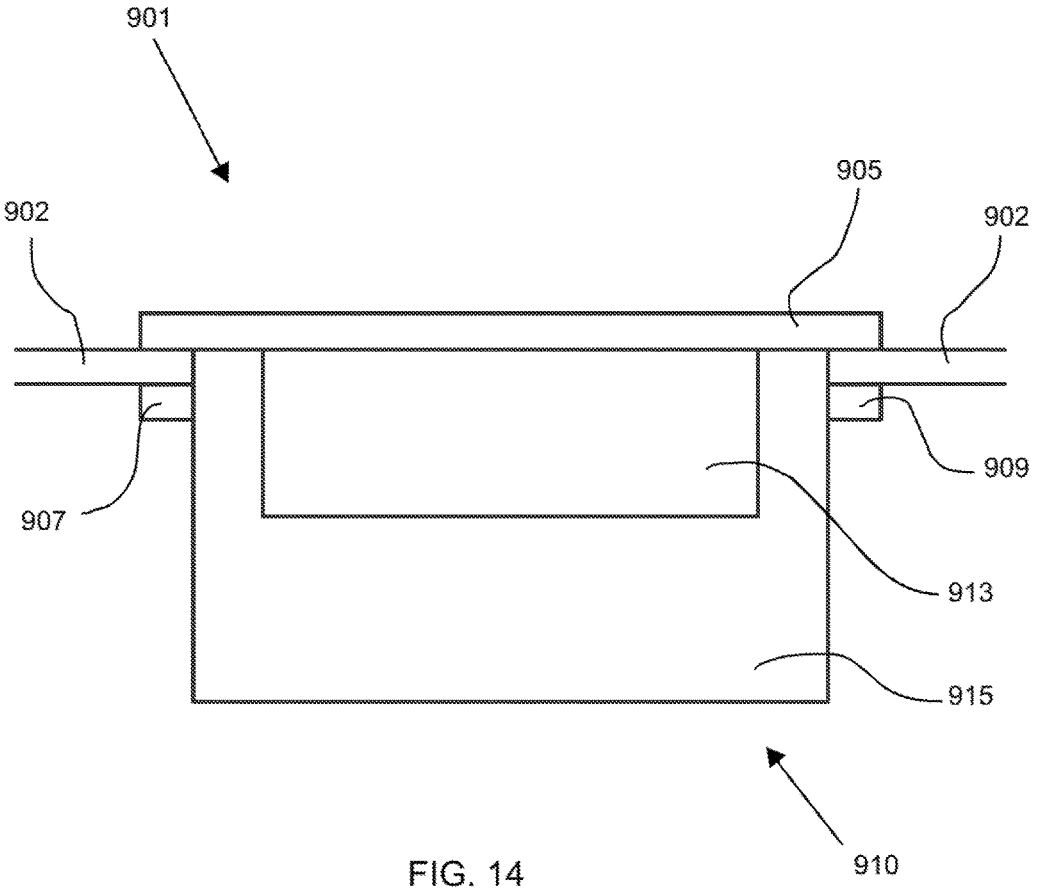
FIG. 14 is a top down view of another embodiment of a dispenser.

FIG. 14 is a top down view of a dispenser 901 according to the disclosure. The dispenser 901 can comprise a faceplate 905, a tissue receptacle 910, and a wipe container 913. The tissue receptacle 910 can be coupled to a substrate 902 by a first tab 907 and a second tab 909. The faceplate 905 can be coupled to the wipe container 913. The faceplate 905 can further be releaseably coupled to the tissue receptacle 910. The wipe container 913 can be open at the top to allow for a user to place wipes within the wipe container 913. A user can place a desired number of wipes within the wipe container 913 and after pulling a first wipe through the faceplate 905, the wipes can be contained in a limited area by the wipe container 913. A cavity 915 of the tissue receptacle 910 can be used to store a refill container of wipes or other materials as may be desired by a user. When the faceplate 905 is decoupled from the tissue receptacle 910, the wipe container 913 can stay coupled to the faceplate 905 to allow a user to easily refill the wipe container 913.

In other embodiments the dispenser can also comprise an automatically opening lid. The faceplate can comprise a motor that can be coupled with the lid and which can be electrically connected to a power source. FIG. 7B, illustrates a motor 212 coupled to the faceplate 201. In one embodiment, a user can press a certain portion of the faceplate and the motor can open the lid so that the user can remove a wipe. In another embodiment, a motion sensor can be communicatively linked to the motor and a user can make a motion in front of the motion sensor to signify the motor should open the lid so the user can remove a wipe. This can have the added benefit of the user not needing to touch the faceplate of the dispenser.

In yet other embodiments, the tissue receptacle can be a drawer type apparatus that can be pulled out from the wall. This would allow a user to store the wipes inside a cavity and yet have more access to the inside of the tissue receptacle when desired without removing a faceplate. In one embodiment, the faceplate is coupled to the tissue receptacle such that a user can pull on the faceplate to pull the tissue receptacle from the cavity and access the tissue receptacle and any wipe or other items that may be present.

Although several embodiments have been described above with a certain degree of particularity, those skilled in the art could make numerous alterations to the disclosed embodiments without departing from the spirit of the present disclosure. It is intended that all matter contained in the above description or shown in the accompanying drawings shall be interpreted as illustrative only and not limiting. Changes in detail or structure may be made without departing from the present teachings. The foregoing description and following claims are intended to cover all such modifications and variations.

Various embodiments are described herein of various apparatuses, systems, and methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments," "one embodiment," "an embodiment," or the like, means that a particular feature, structure, or characteristic described in connection with the embodiment is included in at least one embodiment. Thus, appearances of the phrases "in various embodiments," "in some embodiments," "in one embodiment," "in an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation.

It will be appreciated that the terms "proximal" and "distal" may be used throughout the specification with reference to a clinician manipulating one end of an instrument used to treat a patient. The term "proximal" refers to the portion of the instrument closest to the clinician and the term "distal" refers to the portion located furthest from the clinician. It will be further appreciated that for conciseness and clarity, spatial terms such as "vertical," "horizontal," "up," and "down" may be used herein with respect to the illustrated embodiments. However, surgical instruments may be used in many orientations and positions, and these terms are not intended to be limiting and absolute.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A tissue dispenser comprising:

a faceplate comprising a hinge receptacle, a first faceplate hinge plate depression, a second faceplate hinge plate depression, a dispensing opening, a dispensing gasket, a lid border, a locking channel and a plurality of first coupling members;

a lid comprising a hinge portion, a handle tab, at least one hinge depression, a front face, and a back face;

a hinge plate comprising a hinge opening, a first hinge plate protrusion, a second hinge plate protrusion, a first hinge plate depression, and a second hinge plate depression; and a tissue receptacle comprising at least one flange, a plurality of complementary coupling members, a first side wall, a second side wall, a back wall, a lower wall, and an upper wall, wherein the first side wall, the second side wall, the back wall, the lower wall, and the upper wall form a box configured to store wipes, wherein the hinge swingingly connects the lid to an open position and a closed position, wherein the hinge plate is configured to releaseably couple to the lid and to the faceplate to allow the lid to move to an open and closed position, wherein the first faceplate hinge plate depression releaseably couples to the first hinge plate protrusion and the second faceplate hinge plate depression releaseably couples to the second hinge plate protrusion, and wherein each of the plurality of first coupling members is configured to interact with a corresponding complementary coupling member to releaseably connect the faceplate with the tissue receptacle.

2. The tissue dispenser according to claim 1, wherein the tissue receptacle further comprises a power source.

3. The tissue dispenser according to claim 2, wherein the tissue receptacle further comprises a heater coupled to the power source.

4. The tissue dispenser according to claim 2, wherein the tissue receptacle further comprises a motion sensor coupled to the power source.

5. The tissue dispenser according to claim 2, wherein the power source comprises a battery.

6. The tissue dispenser according to claim 5, wherein the battery comprises a rechargeable battery.

7. The tissue dispenser according to claim 2, wherein the tissue receptacle further comprises a wire receiving throughhole.

8. The tissue dispenser according to claim 2, wherein the tissue receptacle further comprises a heater coupled to the power source and a motion sensor electrically coupled to the power source and communicatively coupled to the heater.

9. The tissue dispenser according to claim 1, wherein the tissue receptacle further comprises a divider.

10. The tissue dispenser according to claim 9, wherein the tissue receptacle further comprises a spring coupled to the divider and to the tissue receptacle.

11. The tissue dispenser according to claim 1, wherein the lid further comprises a motor configured to automatically open the lid.

12. The tissue dispenser according to claim 1, wherein the tissue receptacle further comprises a plurality of screw tabs.

13. The tissue dispenser according to claim 1, wherein the faceplate further comprises a hollow portion on a lower face of the faceplate.

14. The tissue dispenser according to claim 1, wherein each of the plurality of first coupling members comprises a magnet and wherein an end of each of the plurality of complementary coupling members comprises a magnet and the faceplate is configured to releaseably couple to the tissue receptacle through magnetic attraction.

15. A tissue dispenser comprising:

a faceplate comprising a hinge receptacle, at least one faceplate hinge plate depression, a dispensing opening, a dispensing gasket, a lid border, a locking channel and a plurality of first coupling members;

a lid comprising a hinge portion, a handle tab, at least one hinge depression, a front face, and a back face;

a hinge plate comprising a hinge opening and at least one hinge plate protrusion;

a tissue receptacle comprising at least one flange, a plurality of complementary coupling members, a first side wall, a second side wall, a back wall, a lower wall, an upper wall, a heater, a motion sensor, and a power source, wherein the first side wall, the second side wall, the back wall, the lower wall, and the upper wall form a box configured to store wipes, wherein the heater is electrically coupled to the power source and to the motion sensor and is configured to heat an interior of the tissue receptacle when motion is sensed by the motion sensor, wherein the hinge swingingly connects the lid to an open position and a closed position, wherein the hinge plate is configured to releaseably couple to the lid and to the faceplate to allow the lid to move to an open and closed position, wherein the at least one faceplate hinge plate depression releaseably couples to the at least one hinge plate protrusion, and wherein each of the plurality of first coupling members is configured to interact with a corresponding complementary coupling member to releaseably connect the faceplate with the tissue receptacle.

* * * * *